US011541297B2

(12) United States Patent
Bisaillon

(10) Patent No.: US 11,541,297 B2
(45) Date of Patent: Jan. 3, 2023

(54) MIXED MARTIAL ARTS EQUIPMENT

(71) Applicant: Albert Bisaillon, Mission Viejo, CA (US)

(72) Inventor: Albert Bisaillon, Mission Viejo, CA (US)

( * ) Notice: Subject to any disclaimer, the term of this patent is extended or adjusted under 35 U.S.C. 154(b) by 828 days.

(21) Appl. No.: 15/374,638

(22) Filed: Dec. 9, 2016

(65) Prior Publication Data

US 2017/0087438 A1 Mar. 30, 2017

Related U.S. Application Data

(62) Division of application No. 13/763,489, filed on Feb. 8, 2013, now Pat. No. 9,545,126.

(60) Provisional application No. 61/759,282, filed on Jan. 31, 2013, provisional application No. 61/620,936, filed on Apr. 5, 2012, provisional application No. 61/605,696, filed on Mar. 1, 2012.

(51) Int. Cl.

| | |
|---|---|
| ***A63B 71/14*** | (2006.01) |
| ***A41D 13/08*** | (2006.01) |
| ***A41D 19/00*** | (2006.01) |
| ***A41D 19/015*** | (2006.01) |
| ***A63B 69/00*** | (2006.01) |
| *A63B 71/12* | (2006.01) |

(52) U.S. Cl.

CPC ..... *A63B 71/145* (2013.01); *A41D 13/08* (2013.01); *A41D 13/081* (2013.01); *A41D 19/0017* (2013.01); *A41D 19/0048* (2013.01); *A41D 19/01523* (2013.01); *A63B 69/004* (2013.01); *A63B 71/141* (2013.01); *A63B 71/12* (2013.01); *A63B 2209/10* (2013.01); *A63B 2244/10* (2013.01)

(58) Field of Classification Search

CPC .... A41D 13/08; A41D 13/081; A41D 13/084; A41D 13/087; A41D 19/0017; A41D 19/0048; A41D 19/01523; A63B 69/004; A63B 71/12; A63B 2244/10; A63B 71/145

See application file for complete search history.

(56) References Cited

U.S. PATENT DOCUMENTS

| | | | | |
|---|---|---|---|---|
| 1,627,382 A | | 5/1927 | Golomb | |
| 2,556,759 A | * | 6/1951 | Hilton | A63B 71/145 2/18 |
| 4,295,228 A | | 10/1981 | Dragomir | |
| 4,417,359 A | | 11/1983 | Johnson | |
| 4,942,624 A | | 7/1990 | Cho | |
| 5,105,473 A | | 4/1992 | Valtakar | |

(Continued)

OTHER PUBLICATIONS

Copenheaver Blaine R., PCT International Search Report, dated Jun. 25, 2013, pp. 1-13.

*Primary Examiner* — Jameson D Collier
(74) *Attorney, Agent, or Firm* — KOS IP Law LLP

(57) ABSTRACT

An MMA fighting glove is disclosed herein which has a smooth front profile especially at the top and lateral side of the glove when the glove is clenched. In this manner, the glove is less likely to cut an opponent's skin or training partner's skin when the lateral side grazes the opponent or training partner. Moreover, a sleeve may cover a strap mechanism of the MMA glove described herein or a prior art MMA glove to cover any protrusions or aberrations of the strap mechanism to further mitigate cutting of the opponent or training partner.

16 Claims, 24 Drawing Sheets

(56) References Cited

U.S. PATENT DOCUMENTS 5,295,269 A * 3/1994 Ballard ..... A41D 19/01523 2/161.1
5,517,694 A * 5/1996 Fabry ..... A41D 19/01582 2/161.1
5,572,738 A 11/1996 Melone, Jr.
5,575,008 A 11/1996 McBride et al.
5,611,080 A 3/1997 Skottheim
5,781,928 A 7/1998 Avila
5,898,938 A 5/1999 Baylor et al.
5,983,391 A 11/1999 Palmer et al.
6,093,165 A * 7/2000 Estwanik ..... A63B 71/145 2/161.7
6,094,743 A 8/2000 Delgado
6,098,208 A 8/2000 Cordon
6,119,267 A 9/2000 Pozzi
6,202,213 B1 * 3/2001 Georgick ..... A63B 71/145 2/161.1
6,226,795 B1 5/2001 Winningham
6,289,517 B1 9/2001 Minkow et al.
6,374,408 B1 4/2002 Tomlinson et al.
6,584,619 B1 7/2003 Macri
6,691,315 B1 2/2004 Clarke et al.
6,691,316 B2 2/2004 Carlin
7,134,146 B2 11/2006 Westergaard
7,578,004 B2 8/2009 Loyens et al.
7,725,950 B2 6/2010 Hinebaugh
7,779,487 B1 8/2010 Bitzer
7,900,269 B2 3/2011 Morrow et al.
9,545,126 B2 1/2017 Bisaillon
2005/0066404 A1 3/2005 Barker
2007/0118946 A1 5/2007 Spies
2007/0199129 A1 8/2007 Davis
2008/0104737 A1 * 5/2008 Shepherd ..... A41D 13/084 2/20
2011/0099687 A1 5/2011 Skrocki
2012/0144542 A1 6/2012 Evans et al.

* cited by examiner

MIXED MARTIAL ARTS EQUIPMENT

CROSS-REFERENCE TO RELATED APPLICATIONS

This application is a divisional of U.S. application Ser. No. 13/763,489 filed on Feb. 8, 2013, which claims the benefits of U.S. Prov. Pat. App. Ser. No. 61/605,696 filed on Mar. 1, 2012, U.S. Prov. Pat. App. Ser. No. 61/620,936 filed on Apr. 5, 2012 and U.S. Prov. Pat. App. Ser. No. 61/759,282 filed on Jan. 31, 2013, the entire cements of which are expressly incorporated herein by reference.

STATEMENT RE: FEDERALLY SPONSORED RESEARCH/DEVELOPMENT

Not Applicable

BACKGROUND

The embodiments disclosed herein relate to an improved mixed martial arts (MMA) equipment.

An MMA glove typically has minimal padding so that the MMA match is as real as possible to a street fight. Unfortunately, by adding gloves to the MMA sport, the gloves themselves become a hazard to the participants of the sport. For example, the gloves may have protuberances and other rough features. These protuberances and rough features may cut the opponent's skin and cause bleeding. During a fight, the fighters will jab and throw punches. As the opponent maneuvers to avoid being hit, the glove may graze his/her skin. The protuberances and rough features of the glove may cut the fighter and cause the fighter to start bleeding. If excessive, the fight may be stopped or temporarily suspended until the bleeding can be controlled. Moreover, due to protrusions and rough features of the glove, certain maneuvers are not performed during a fight for one reason or another.

In addition to padding, fighters tape up their hands to provide support and to prevent hand fractures when punching. Unfortunately, the process of taping up a fighter's hand is quite cumbersome. By way of example and not limitation, fighters will wrap their hands with a strip of cloth material numerous times. Each wrapping is supposed to provide additional wrist and bone support to mitigate hand fractures during punching. Unfortunately, fighters still fracture their hands when punching. Moreover, since the strip of cloth material must be wrapped around the fighter's hand numerous times, the wrapping is quite thick which makes inserting the hand into a glove more difficult, if not impossible thereby requiring the fighter to wrap his or her hands again.

The MMA fighter trains as he/she will fight. This means that the MMA fighter will use the same equipment that he/she fights in to train. This means that the normal fighting glove is used to train. Unfortunately, this exposes the training partner to potential cuts from protuberances and rough features of the glove. Prior art gloves or MMA gloves expose training partners to an increased risk of cuts and abrasions caused by various protrusions or aberrations of the MMA prior art glove. Other padding used by the fighter may have protuberances and rough features that cause cuts during training and an actual fight.

Accordingly, there is a need in the art for an improved mixed martial arts fighting glove.

BRIEF SUMMARY

The embodiments disclosed herein address the needs discussed above, discussed below and those that are known in the art.

The MMA fighting glove disclosed herein includes a lateral padding that does not have any creases or significant protrusions or rough features when the fighter's hand is clenched. To this end, the lateral padding is formed with a padding material which is covered by an exterior layer. The exterior layer may be stretched over the padding and sewn to a base layer. In this manner, the lateral padding may always be under a compressive load by the exterior layer. Moreover, the lateral padding is blended in with the top padding so that there is a smooth profile between the lateral and top padding to mitigate cuts. Additionally, the MMA glove may have a sleeve for covering the strap mechanism of the MMA glove. It has been found that the strap mechanism and the glove itself oftentimes graze the opponent's or training partner's skin and cuts the skin of the opponent or training partner. By forming lateral padding without rough features when the fighter's hand is clenched, forming a smooth profile between the lateral and top paddings and using the sleeve which covers any protrusions or rough features of the strap mechanism, the improved MMA glove mitigates cutting of the opponent or training partner. Moreover, the lateral padding assists in helping the fighter to execute a hammer fist move as well as acclimating to the hammer fist move when on the receiving end.

More particularly, a mixed martial arts glove is disclosed. The glove may comprise a finger section, a padded body and a securing system. The finger section may have four finger tubes terminating at a midpoint of the fighter's fingers. The finger section may define an exterior area and an interior area. The exterior area may have a padding to soften a punch to an opponent or training partner. The interior area may be sufficiently thin so that the fighter can grab an appendage of the opponent/training partner when desired.

The padded body may be integral with the finger section. The body may define lateral, top, medial and bottom areas. The top and lateral areas may have separate pads. The top and lateral areas may have exterior layers which define exterior surfaces. The exterior surfaces of the exterior layers are blended to each other to form a generally continuous front profile when the fighter's fist is clenched to mitigate cutting of the opponent during a fight or the training partner during a training session.

The securing system may be attached to the padded body to secure the fighting glove to the fighter's hand.

The pads of the top and lateral areas may be fabricated from foam, sponge, rubber, gel, injection foam molding, horsehair, cotton fiber or combinations thereof.

A single stitch may run along a length of the glove between the top and lateral areas.

The bottom area of the padded body may be sufficiently thin so that the fighter may grab the opponent's appendage.

It is also contemplated that exterior layers of the top and medial areas may define exterior surfaces which are blended to each other to form a generally continuous and smooth front profile when the fighter's fist is clenched to mitigate cutting of the opponent during the fight or training session.

A top layer and a lateral layer (i.e., exterior layers of the top and lateral areas) may compress the top and lateral pads so that the top and lateral pads are generally smooth whether the fighter's fist is clenched or relaxed. The lateral pad may extend parallel to a lateral side of the fighter's hand.

In another aspect, a mixed martial arts fighting glove is disclosed. The glove may comprise a finger section, a padded body, a securing system and an elastic sleeve. The finger section may have four finger tubes. An exterior area of the finger section may have a padding to soften a punch to an opponent. The padded body may be integral with the finger section to soften a punch to an opponent. The securing system may be attached to the padded body to secure the fighting glove to the fighter. The elastic sleeve may be fabricated from a soft material having a length greater than the securing system so that the sleeve may be pulled over the securing system to cover the securing system and protect the opponent from abrasion cuts from the securing system.

The elastic sleeve may be attached to a lower periphery of the securing system and be pulled down to uncover the securing system when putting on or taking off the glove from the fighter, and pulled up over the securing system after putting the glove on the fighter. The free distal peripheral portion of the sleeve may have an elastic band to hold the sleeve in place during the fight or training session. Friction material (e.g., rubber) may be disposed on an inner surface of the free distal peripheral portion of the sleeve to help hold the sleeve in position.

It is also contemplated that the elastic sleeve may be attached adjacent to an upper area of the securing system and may be pulled up to uncover the securing system when putting on or taking off the glove from the fighter, and pulled down over the securing system after putting the glove on the fighter. The free distal peripheral portion of the sleeve may have an elastic band to hold the sleeve in place during the fight or training session. Friction material (e.g., rubber) may be disposed on an inner surface of the free distal peripheral portion of the sleeve to help hold the sleeve in position.

The sleeve discussed herein may be fabricated from spandex or neoprene.

In another aspect, a mixed martial art hand protection system having a wrist securement device is disclosed. The system may comprise a glove and a strap. The glove has a wrist portion and the strap has a non-elastic portion secured to the wrist portion and an elastic portion secured to the non-elastic portion. The non-elastic portion is removably securable to the wrist portion with a hooks and loops system and the elastic portion is removably securable to the non-elastic portion and the wrist portion with a hooks and loops system. The non-elastic portion may be secured to a bottom flap of the wrist portion and the elastic portion may be secured to a top flap of the wrist portion and to a different portion of the elastic portion.

A top flap of the wrist portion may have a compressible support member for reinforcing a top portion of the fighter's hand as the strap is wrapped around the wrist portion of the glove. The compressible support member may have a rectangular cross sectional configuration or a rearward facing wedge shaped cross section.

In another aspect, a hand wrap for a fighter is disclosed. The wrap may comprise a stretchable sleeve, an elastic strip of cloth and a hook and loop system. The stretchable sleeve may have a thumb opening. The elastic strip of cloth is for the purpose of reinforcing the fighter's hand by wrapping the strip of cloth around the wrist and hand of the fighter. A hook and loop system may be disposed at the end portion of the strip of cloth for securing the strip of cloth.

The wrap may further have an elastic band at an upper end portion of the stretchable sleeve for providing compression to the fighter's hand.

In another aspect, a forearm and elbow pad system is disclosed. The system may comprise a forearm and elbow pad, a shirt and a compression sleeve. The forearm and elbow pad may be disposed on the forearm and elbow of a fighter when worn. The shirt may have a shirt sleeve with pockets formed on an interior side of the sleeve for holding the forearm and elbow pad. The compression sleeve may be attached to a distal end portion of the sleeve of the shirt and be sufficiently long to be folded over the shirt sleeve onto the forearm and elbow pad for securing the forearm and elbow pad in place when worn.

The forearm and elbow pad may have a plurality of padding elements that are pivotable with respect to each other about a living hinge. The compression sleeve having at least one compression band which is aligned to one of the living hinges connecting the padding elements when the compression sleeve is folded back over the shirt sleeve.

The compression sleeve may have first, second and third three compression bands. The first compression band may be disposed below the forearm and elbow pad. The second compression band may be disposed at one hinge of the living hinges. The third compression band may be disposed above the forearm and elbow pad.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 5:
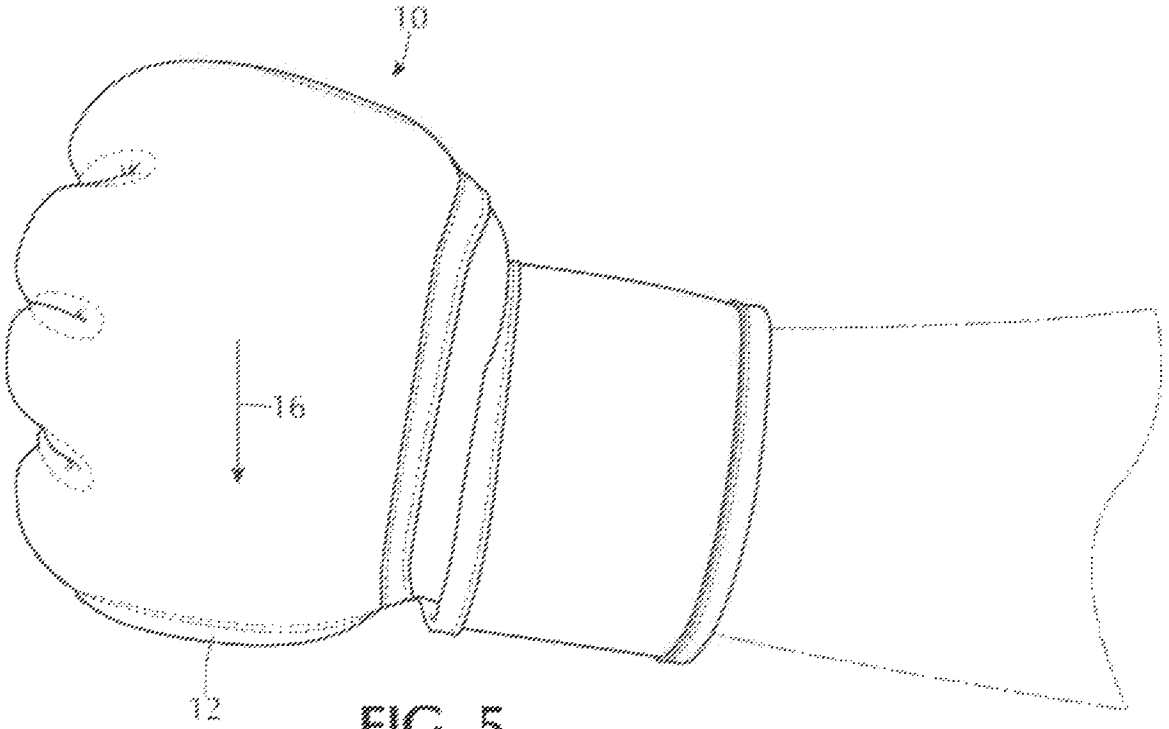
FIG. 5 illustrates the glove shown in FIG. 1 while the fighter is executing a hammer fist move.

Referring now to the drawings, an improved fighting glove 10 is shown. The improved fighting glove 10 has a lateral padding 12 (i.e., padding adjacent to small finger) which does not have any creases, significant protrusion or rough features whether the fighter's hand 14 is relaxed (see FIG. 1) or clenched (see FIG. 3). As such, when the fighter is fighting in a match or training, the lateral sides of the fighting gloves 10 mitigate cutting the opponent or training partner. The lateral padding 12 may also be blended with the top padding to mitigate cutting of the opponent or training partner. Moreover, the lateral padding 12 allows the fighter to perform a hammer strike move by clenching his/her fist and forcefully striking his/her opponent or training partner in a 12 o'clock to 6 o'clock direction, as shown by arrow 16 in FIG. 5. The lateral padding 12 protects the opponent or training partner from significant physical impact caused by such a powerful blow. Moreover, the lack of any protrusions from the lateral padding 12 as shown in FIG. 5 protects the opponent and the training partner from cuts when the hammer strike is performed. Moreover, a sleeve 18 may be positioned around the strap mechanism 20 to cover any protrusion or rough features that might cut the opponent or training partner. The sleeve 18 may be used in conjunction with the improved fighting glove 10 or a prior art MMA fighting glove. The sleeve 18 is stretched out and worn about the strap mechanism of the glove.

Figure 1:
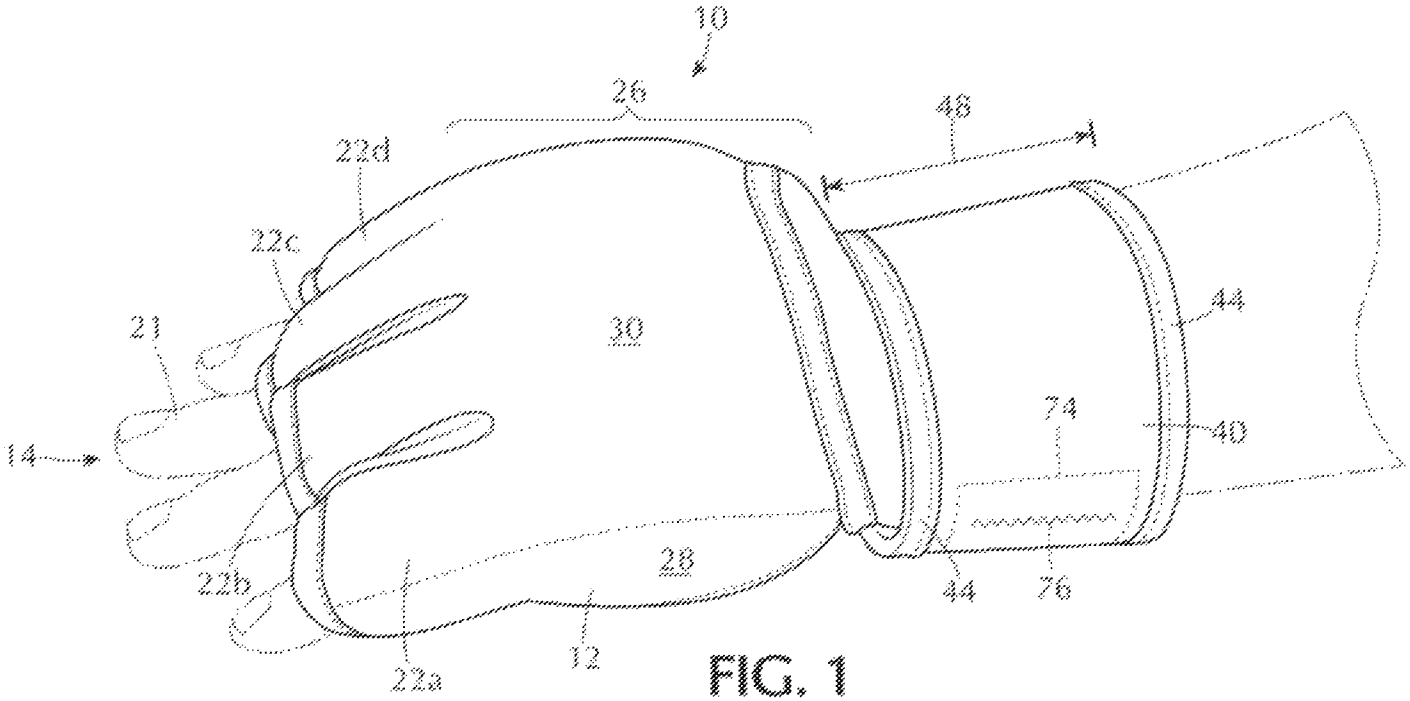
FIG. 1 is a perspective view of a top side of an improved MMA fighting glove.
Figure 2:
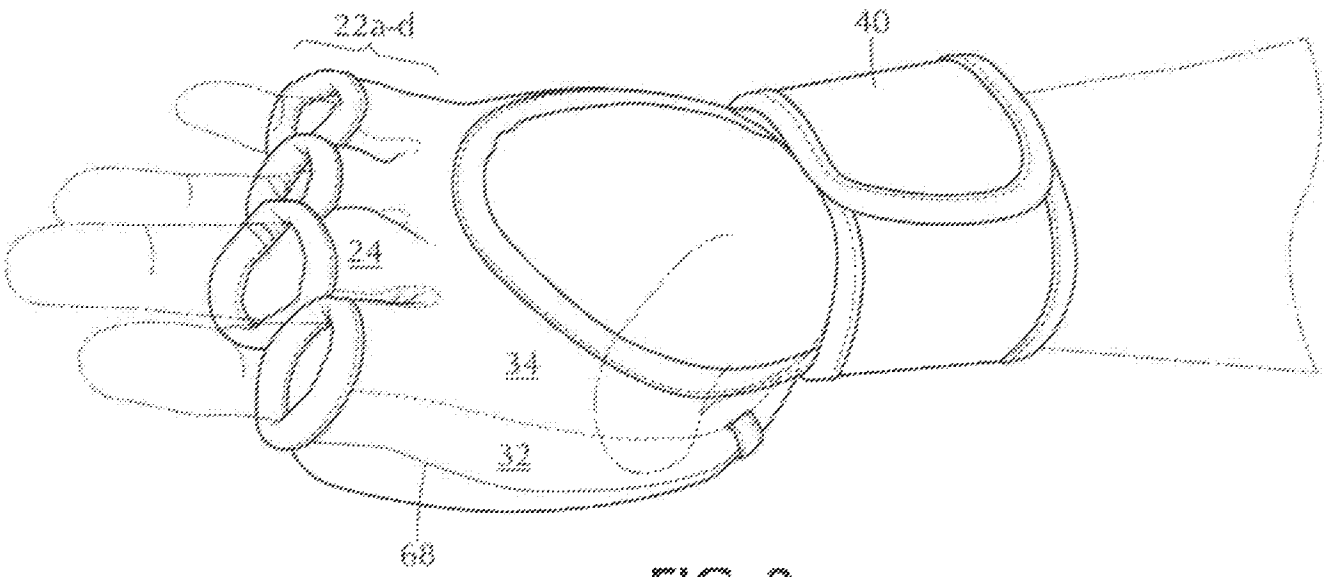
FIG. 2 is a perspective view of a bottom side of the improved MMA fighting glove shown in FIG. 1.
Figure 3:
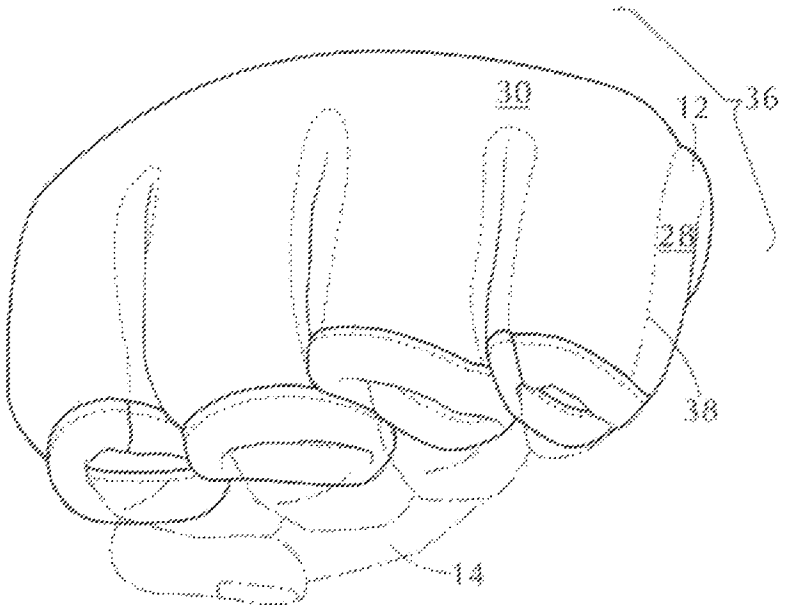
FIG. 3 is a front view of the glove shown in FIG. 1 with the fighter's hand in a clenched position.

More particularly, the MMA (mixed martial art) glove 10 may have four finger sections 22*a-d*. The four finger sections 22*a-d* terminate at the middle of the fingers 21 of the fighter's hand 14. An exterior area of the finger section 22*a-d* may have padding to soften a punch to an opponent or training partner. The exterior area is shown in FIG. 1. The underside or the interior area 24, as shown in FIG. 2, may have an absence of padding so that the fighter can grasp the opponent's or training partner's appendages (e.g., arms and legs). The MMA glove 10 may additionally have a padded body 26. The padded body 26 is attached to or made integral with the finger sections 22*a-d* and also defines the lateral area 28, top area 30, medial area 32 and bottom area 34, as shown in FIGS. 1 and 2. The padded body 26 extends from the finger sections 22*a-d* to about the wrist. The padded body 26 may have padding at the lateral area 28 and the top area 30 (see FIG. 1) and optionally at the medial area 32 (see FIG. 2). Similar to the finger sections 22*a-d*, the bottom area 34 of the padded body 26 may be absent of padding so that the fighter can grasp the opponent's or training partner's appendages. The padding at the top area 30 of the padded body 26 and the finger sections 22*a-d* may be fabricated from a unitary padding material (e.g., foam, rubber, etc.). The exterior surface may be fabricated from leather or other similar material and sewn over the padding material. The exterior layer of the finger sections 22*a-d* and the padded body 26 may be sewn to a base material. During fights and training sessions, the lateral outer periphery 36 (see FIG. 3) of the front profile of the MMA glove 10 frequently grazes the opponent's face and skin. Any aberrations, protrusions or rough features in this area may cut the opponent's or training partner's skin. As can be seen in FIG. 3, the padding at the top area 30 of the padded body 26 and the lateral padding 12 has a smooth profile even when the fighter's fist is clenched. Accordingly, the improved MMA glove 10 mitigates cuts in the opponent's or training partner's skin.

The padding of the lateral padding 12 may be fabricated from a unitary material and sewn to the glove 10 with thread by way of stitching 38. The improved MMA glove 10 shown in FIG. 3 has two separate padding, one for the top area 30 of the padded body 26 and another for the lateral padding 12. By way of example and not limitation, the lateral padding 12 may be about 4 inches long and 1¼ to 3¼ inches wide. It is this area of interest which may be designed to have a smooth surface or profile to prevent cutting of the opponent's or training partner's skin.

Figure 4:
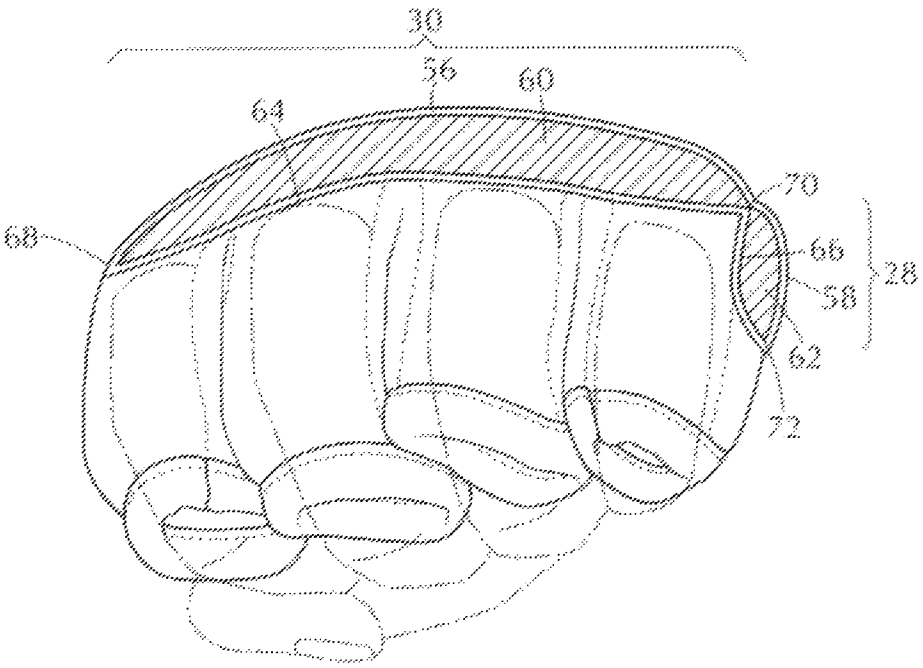
FIG. 4 is a cross sectional front view through top and lateral pads of the glove shown in FIG. 3.

Referring now to FIG. 4, a cross sectional view of the top padding area 30 and the lateral padding area 28 are shown. The cross section is taken at about the middle of the top of the person's hand. The top padding area 30 and the lateral padding area both define exterior layer 56, 58, padding 60, 62, and lower layer 64, 66 (i.e., base material). The exterior layers 56, 58 may be sewn to the lower layers 64, 66 at locations 68, 70, 72. Location 70 is also shown as stitching 38 in FIG. 3. Location 68 is also shown in FIG. 2. Sandwiched between the exterior layers 56, 58 and the lower layers 64, 66 are pads 60, 62. The stitching at 68, 70, 72 may extend to the tips of the finger section from the base of the padded body 26 as shown in FIGS. 1 and 2.

The lower layers 64, 66 may be fabricated from breathable fabric material. The exterior layers 56, 58 may be fabricated from a durable material such as leather. By way of example and not limitation, the pads 60, 62 may be fabricated from open or close foam, rubber, sponge, gel, injection foam molding, horsehair, cotton fiber or combinations thereof. More particular, the lateral pad, 62 may be fabricated from 4 mm soft foam, whereas the top pad 60 may be fabricated from 35 mm close or open cell foam impact resistant padding.

During a fight, the fighter's hand may be clenched when throwing a punch. The padding 62 at the lateral padding area 28 may optionally be curved and preformed to the user's clenched hand. This mitigates the exterior layer 58 from forming wrinkles, folds and other rough features that might cut the opponent or training partner. Moreover, the exterior layers 56, 58 of the top and lateral padding areas 30, 28 may optionally be wrapped around the pads 60, 62 so that the exterior layers 56, 58 presses against the pads 60, 62. The exterior layers 56, 58 may compress the pads 60, 62. In this manner there is less movement and wrinkling of the exterior layers 56, 58 so that the exterior layers 56, 58 do not fold or otherwise produce rough features when the fighter clenches his/her hand.

The exterior layers 56 and 58 may be blended with each other so that the front profile of the glove 10 when worn and the fighter's hand is clenched is smooth as shown in FIGS. 3 and 4. As can be seen in FIG. 3, the exterior surface of the top area 30 blends with the exterior surface of the lateral area 28. There are no significant aberrations or rough features.

The pads 60, 62 are separate and individual pads. However, it is also contemplated that the pads 60, 62 may be fabricated from a unitary pad. If the pads 60, 62 are fabricated from a unitary pad, then no stitching 70, 38 would be utilized. Rather, the exterior layers 56, 58 would be attached to the lower layers 64, 66 at location 68 and 72. The top and lateral pads 60, 62 may be curved and shaped to the shape of the fighter's hand.

Referring now to FIG. 5, a profile of the improved MMA fighting glove 10 is shown while executing a hammer strike move. The hammer strike move is performed when the fighter strikes his/her fist from the 12 o'clock position to the 6 o'clock position onto the opponent's body while the opponent is lying on the ground. The lateral padding 12 blunts the power of the hammer strike move against the opponent or training partner. Moreover, as discussed, the lateral padding 12 does not have any significant protuberances, wrinkles or other edges which might cause cuts on the opponent or unnecessary damage. The improved MMA glove 10 may be utilized during training so that the fighter can train with a training partner and execute the hammer strike move in full force without causing significant harm to the training partner. During an MMA fight, the fighter can use a normal glove which does not have lateral padding 12 or has sub-optimally shaped lateral sides to the MMA glove so that the fighter can impose maximum damage to the opponent. As such, the improved MMA glove 10 allows the fighter to train as he/she might fight during a real match but yet protect his/her training partner and impose maximum damage to his or her opponent. Also, the training partner may wear the improved MMA glove 10 and execute the hammer strike on the MMA fighter. This allows the fighter to grow accustomed to feeling the hammer strike blow. Accordingly, the improved MMA glove 10 can be worn by the training partner as the fighter is receiving the hammer strike blow to condition the fighter's body and mind to receive hammer strike blows and react accordingly.

In the glove 10 shown and described above, the top pad 60 and the lateral pad 62 are two separate pads or elements. However, it is also contemplated that the top pad 60 and the lateral pad 62 may be fabricated from a unitary material. The unitary pad material extends from the top area 30 to the lateral area 28. Stitching at location 70 is optional. In a further alternative embodiment, the medial area 32 may be padded. The pad at the medial area 32 may be separate from the pad 60 at the top area 30. Alternatively, the pad at the medial area 32 may be fabricated from a unitary material with the pad 60 at the top area 30. The stitching at location 68 would be optional when the pad at the medial area 32 is unitary with the pad 60 at the top area. In a further alternative embodiment, the pad at the medial area 28, the pad 60 at the top area 30 and the pad 62 at the lateral area 32 may be fabricated from a unitary material. In this instance, the stitching 68, 70 are optional. The pad at the medial area 28 may be compressed with the exterior layer of the glove 10 at the medial area 28. This may be accomplished by stretching the exterior layer over the unitary pad similar to the manner in relation to the exterior layers 56, 58 over the pads 60, 62.

Figure 6:
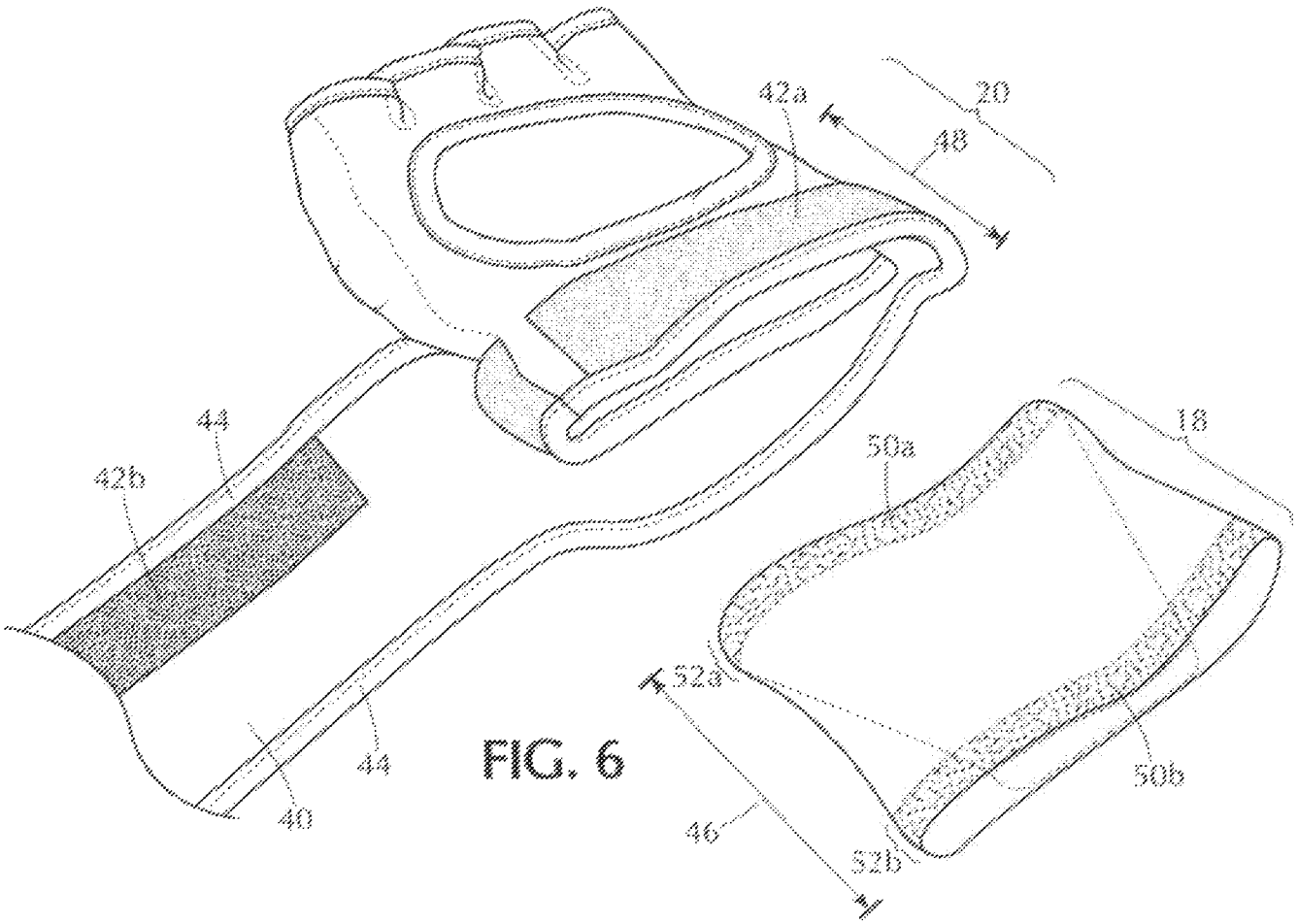
FIG. 6 illustrates an MMA glove with a separate sleeve that is worn about a strap mechanism of the MMA glove.
Figure 7:
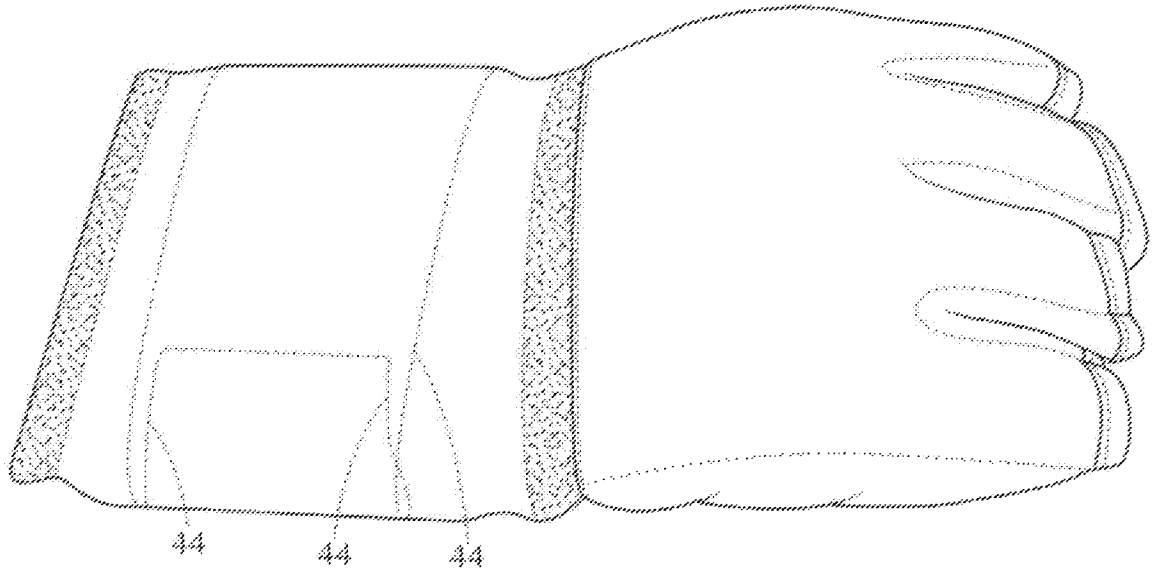
FIG. 7 illustrates the sleeve shown in FIG. 6 disposed over the strap mechanism of the glove shown in FIG. 6.

Referring now to FIG. 6, a sleeve is shown to mitigate cutting. To wear the improved MMA glove 10, the strap mechanism 20 is undone. The fighter inserts his/her hand 14 into the glove 10 and secures the straps 40 by way of hooks and loops 42*a, b*, as shown in FIGS. 1 and 2. The strap 40 may have reinforced edges 44 (see FIGS. 1 and 6). The reinforced edges 44 graze the opponent's and training partner's skin and cause cuts. Other parts adjacent or at the strap mechanism 20 may also cause cuts. To mitigate cuts, the protective sleeve 18 (see FIG. 6) may be slipped over the strap mechanism 20 as shown in FIG. 7. The sleeve 18 is stretched out and fits over the strap mechanism snugly. The sleeve 18 may have a length 46 (see FIG. 6) (e.g., 4¼" inches) which is significantly longer than a length 48 (see FIG. 6) of the strap mechanism 20 to cover the strap mechanism 20. When the sleeve 18 is slipped over the strap mechanism 20, the sleeve 18 covers the entire strap mechanism 20. The sleeve 18 may for example be 3½ inches wide. The sleeve 18 covers the reinforced edges 44 and any other protuberances and rough features to provide another layer of protection against inadvertent cutting of the opponent or training partner.

As shown in FIG. 6, the sleeve 18 is detached from the glove 10. The opposed distal end portions of the sleeve 18 may have an elastic band 50*a, b* (e.g., ¾ inches wide) that may be sewn into the opposed distal seams 52*a, b* of the sleeve 18. The elastic bands 50*a, b* compress on the glove or the wearer's skin to hold the position of the sleeve 18 during use. The elastic bands 50*a, b* prevent or mitigate slippage of the sleeve 18 during training or a fight. The elastic bands 50*a,b* help to maintain the sleeve 18 in position to cover the reinforcement edges 44 and other protuberances to protect the opponent or training partner.

The sleeve 18 is not permanently attached to the glove 10. Rather the sleeve 18 may be removed and washed when dirty. The sleeve 18 may be replaced when worn. The elastic bands 50*a, b* maintain the sleeve 18 over the strap mechanism 20 during a fight. For example, when the fighter is grappling with the opponent or training partner, the glove 10 oftentimes rubs against the ground/mat or the body of the opponent or partner. As a result, the sleeve 18 may roll up and expose the strap mechanism so that the opponent or training partner might be cut by the exposed strap mechanism 20. Fortunately, the elastic band 50*a* prevents the sleeve 18 from rolling down. The elastic band 50*b* prevents the sleeve 18 from rolling up.

In the embodiment shown in FIGS. 6 and 7, the circumference of the sleeve at the elastic band 50*b* may be smaller than the circumference of the sleeve at the elastic band 50*a*. In this manner, the elastic band 50*b* may provide for a tighter fit with the wrist of the user. Moreover, it is also contemplated that the entire sleeve 18 may be elastic with a tapered configuration with or without elastic bands 50*a, b*. One end of the sleeve 18 will have a smaller opening compared to the opening on the opposite end. This is shown in dashed lines in FIG. 6.

Figure 8:
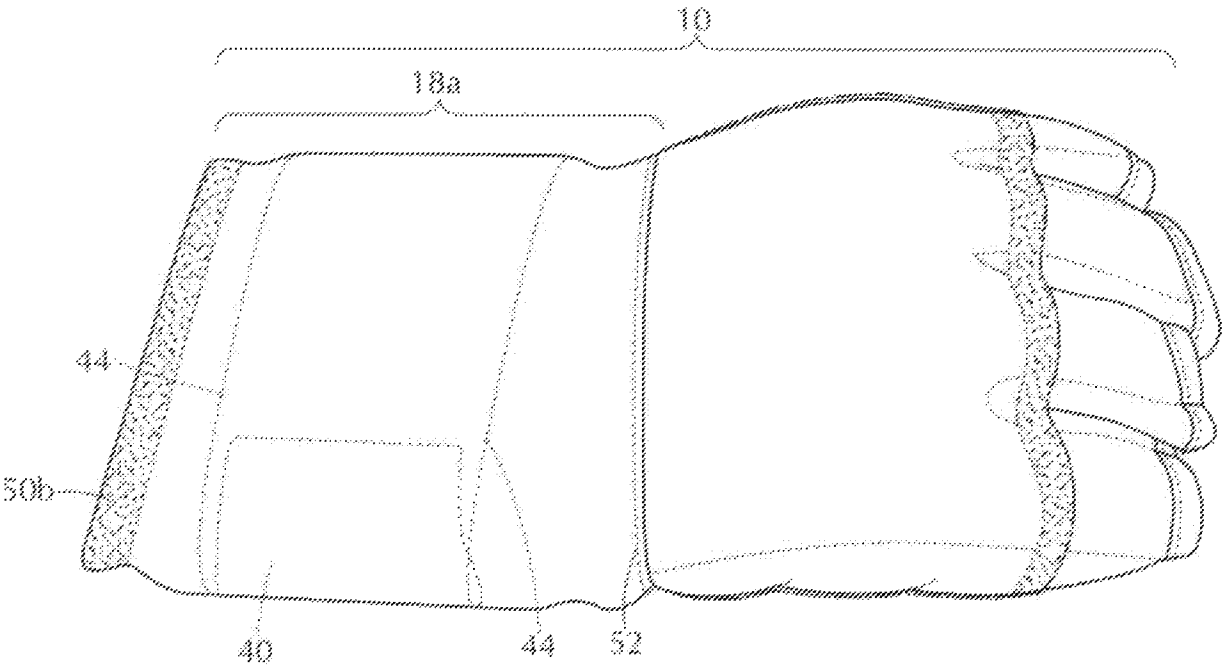
FIG. 8 is a second embodiment of the sleeve.

FIG. 8 illustrates a second embodiment of the sleeve 18*a* and the MMA glove 10. In the embodiment shown in FIGS. 6 and 7, the sleeve 18 was detached from the improved MMA glove 10. As such, the sleeve 18 can be washed separately when soiled. In FIG. 8, the sleeve 18*a* is attached to the glove 10. By way of example and not limitation, the upper distal end of the sleeve 18*a* may be permanently sewn to the MMA glove 10 via stitching 52. The stitching 52 may extend along the entire circumference of the glove 10 above strap mechanism 20. The stitching 52 may be above the strap 40 so that the sleeve 18 may be pulled up and the strap 40 undone or engaged as desired when taking off or putting on the glove 10. The stitching 52 may also be a spot stitching at a single location (e.g., top, bottom, left side or right side) or a short section (e.g., top, bottom, left side or right side) instead of circumscribing the entire glove 10. The stitching 52 prevents the sleeve 18*a* from rolling down off of the glove 10 during use. The sleeve 18*a* may also have elastic band 50*b* opposite from the stitching to prevent the sleeve 18*a* from rolling up on the glove 10. The elastic band 50*b* is at the lower distal end of the sleeve 18*a*.

Although the stitching 52 is described as being a permanent attachment (e.g., stitching), it is also contemplated that the upper distal end of the sleeve 18*a* may be removably attached to the glove 10 through technology known in the art or developed in the future. By way of example and not limitation, the inner surface of the sleeve 18*a* may be lined with hooks, whereas the outer surface of the glove 10 may be lined with loops. The hooks and loops may be removably attached to each other as desired. The sleeve 18*a* may be slipped conveniently upward as shown in phantom lines in FIG. 8 while removing or putting on the glove 10. If the sleeve 18*a* needs to be washed, the sleeve 18*a* may be removed from the glove 10 by detaching the hooks and loops. Other removable attachable mechanisms may be utilized in lieu of or in addition to hooks and loops such as zippers, buttons and snaps.

The glove 10 shown in FIG. 8 is worn and removed as is normal with the strap mechanism 20. To engage the strap mechanism 20 or undo the strap mechanism 20, the sleeve 18*a* is pulled up over the padded body 26 as shown in phantom lines to move the sleeve 18*a* out of the way from the strap mechanism 20. After manipulating the strap mechanism 20, the sleeve 18*a* may be pulled down over the strap mechanism 20 as shown in solid lines to cover the reinforced edges and other protuberances adjacent to or at the strap mechanism 20.

Referring still to FIG. 8, the opening of the sleeve at the elastic band 50*b* may be sufficiently small so that the elastic band 50*b* will fit snugly against the wearer's wrist. The sleeve 18*a* may have a tapered configuration as shown in the figure. Moreover, it is also contemplated that the sleeve 18*a* may be completely elastic instead of or in addition to forming the elastic band 50*b* on the sleeve 18*a*.

Figure 9:
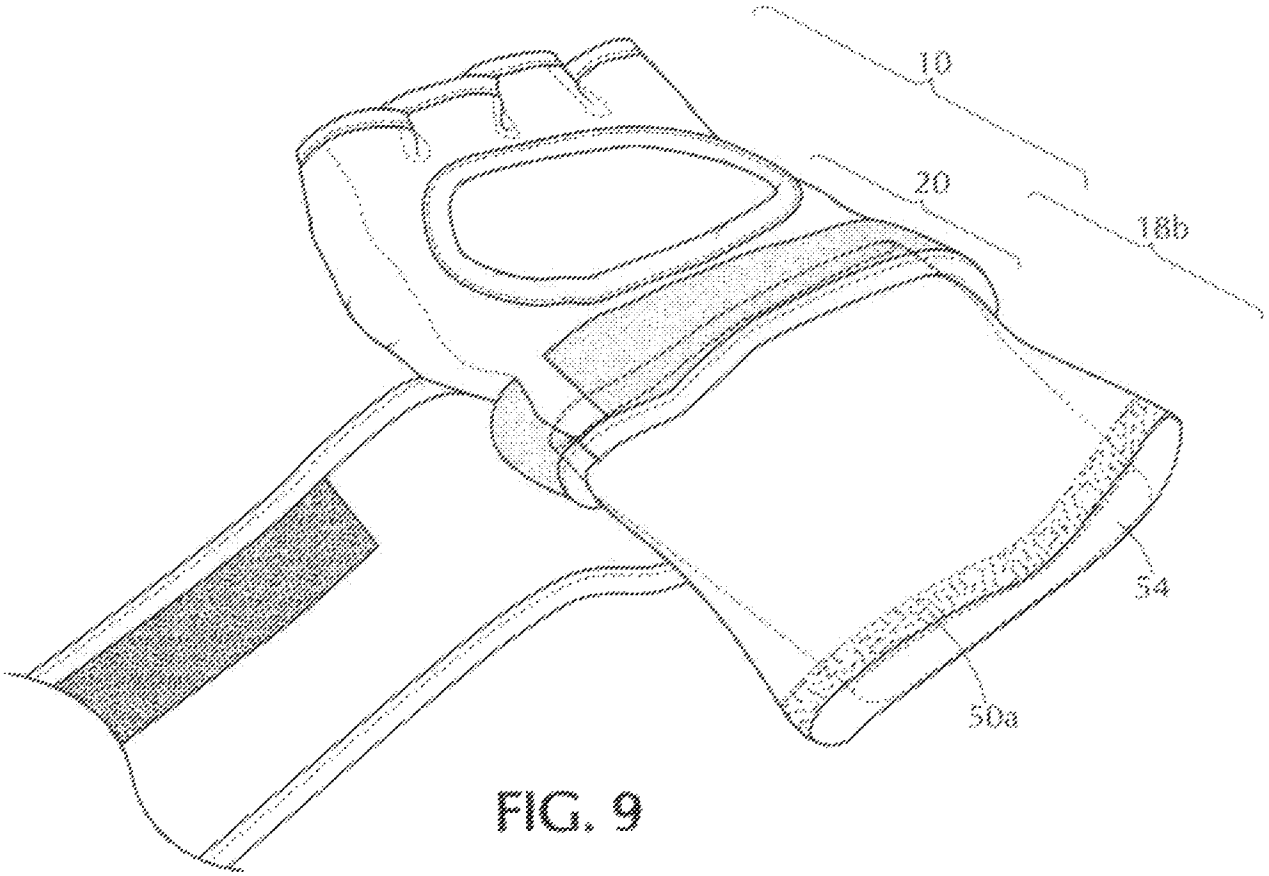
FIG. 9 is a third embodiment of the sleeve attached to the glove.
Figure 10:
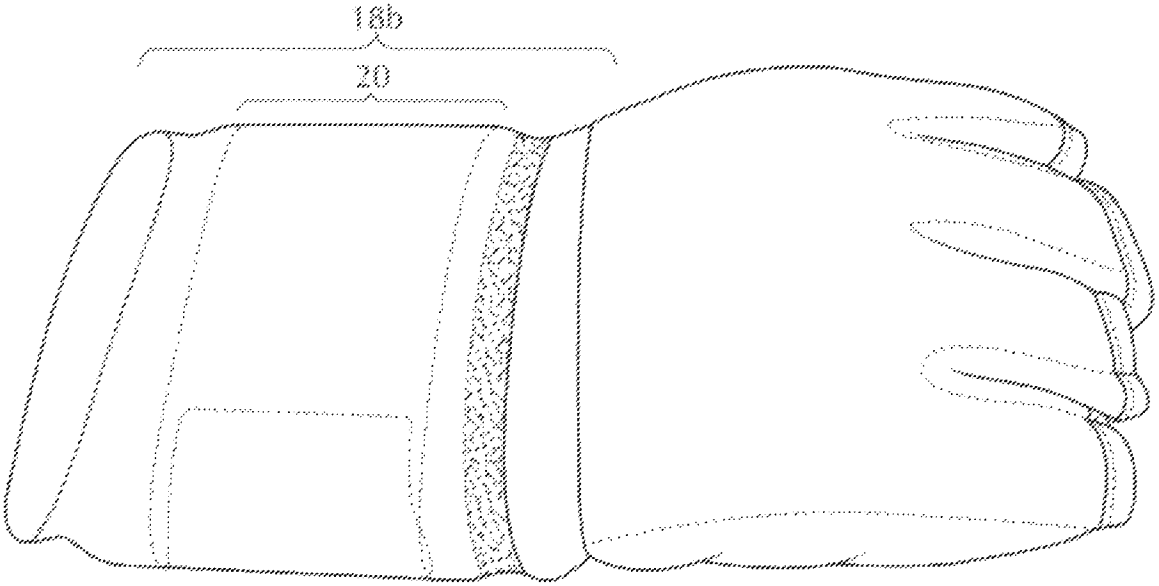
FIG. 10 illustrates the sleeve shown in FIG. 9 covering the strap mechanism.

Referring now to FIGS. 9 and 10, a third embodiment of the sleeve 18*b* is shown. The sleeve 18*b* may be attached to the bottom portion of the strap mechanism 20. In particular, the lower distal openings may be secured to the inside of the strap mechanism 20 as shown in FIG. 9. The sleeve 18*b* may be secured to the inside of the strap mechanism 20 about its entire inner periphery or portion thereof. Moreover, it is also contemplated that securing means by which the sleeve 18*b* is attached to the strap mechanism 20 may be removable so that the sleeve 18*b* can be selectively removed from the glove 10 as desired. By way of example and not limitation, the securing means may be hooks and loops, snaps, etc. The user slips his/her hand within the proximal opening 54 of the sleeve 18*b* and into the glove 10 as normally done. The user engages the strap mechanism 20. Once the strap mechanism is engaged, the proximal opening 54 is pulled upward over the strap mechanism 20 as shown in FIG. 10, to cover the reinforced edges of the strap mechanism and other areas of the glove 10 adjacent to the strap mechanism 20 that might cut the opponent or training partner. Elastic band 50*a* holds the sleeve 18*b* in place during a fight or training session.

Referring still to FIG. 9, the sleeve 18*b* may have a tapered configuration as shown in dashed lines. The opening at the elastic band 50*a* may be sufficient small so that the elastic band fits snugly against the wearer's wrist. Moreover, it is contemplated that the sleeve 18*b* may be completely elastic instead of or in addition to forming the elastic band 50*a*.

Figure 1A:
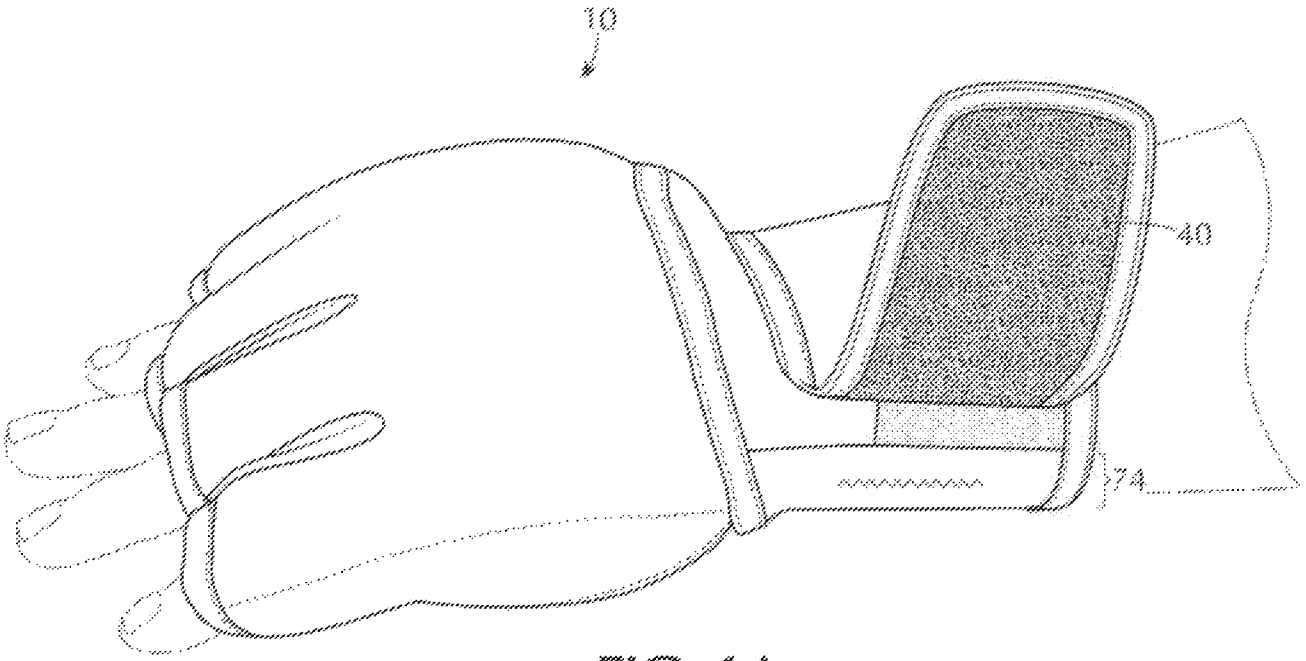
FIG. 1A is a perspective view of the top side of the improved MMA fighting glove shown in FIG. 1 with a writable surface covered by the strap when worn to prevent a writing indicia from smearing off during training or fighting.

Referring back to FIGS. 1 and 1A, the glove 10 may have a writable surface 72 stitched into the glove 10 at a location under the strap 40 when the glove 10 is worn. In a training gym, fighters, training partners, etc. will each have a glove. Oftentimes, the gloves 10 used by all of these fighters are from the same company and have the same style. As such, it is difficult to distinguish two different pairs of gloves 10. The glove 10 disclosed herein may have an optional writable surface 74 stitched into the glove 10 at a location which is covered by the strap 40 when the strap mechanism 20 is engaged. As shown, the writable surface 74 may be attached to the glove 10 at the base of the strap 40 adjacent to a wrist portion of the glove 10. FIG. 1A shows the writable surface 74 being exposed just prior to the strap being wrapped over the writable surface 74 and attached to the underside of the glove 10 with hooks and loops. The writable surface 74 may be any type of material known in the art or developed in the future. The writable surface may also be washable. As shown in FIG. 1, when the strap 40 is engaged, the writable surface 74 is covered. During a fight or training session, the strap 40 protects the written indicia 76 written on the writable surface 74 from being wiped off. The owner of the glove 10 may write his or her name on the writable surface 74 to identify his pair of gloves 10.

Figure 11:
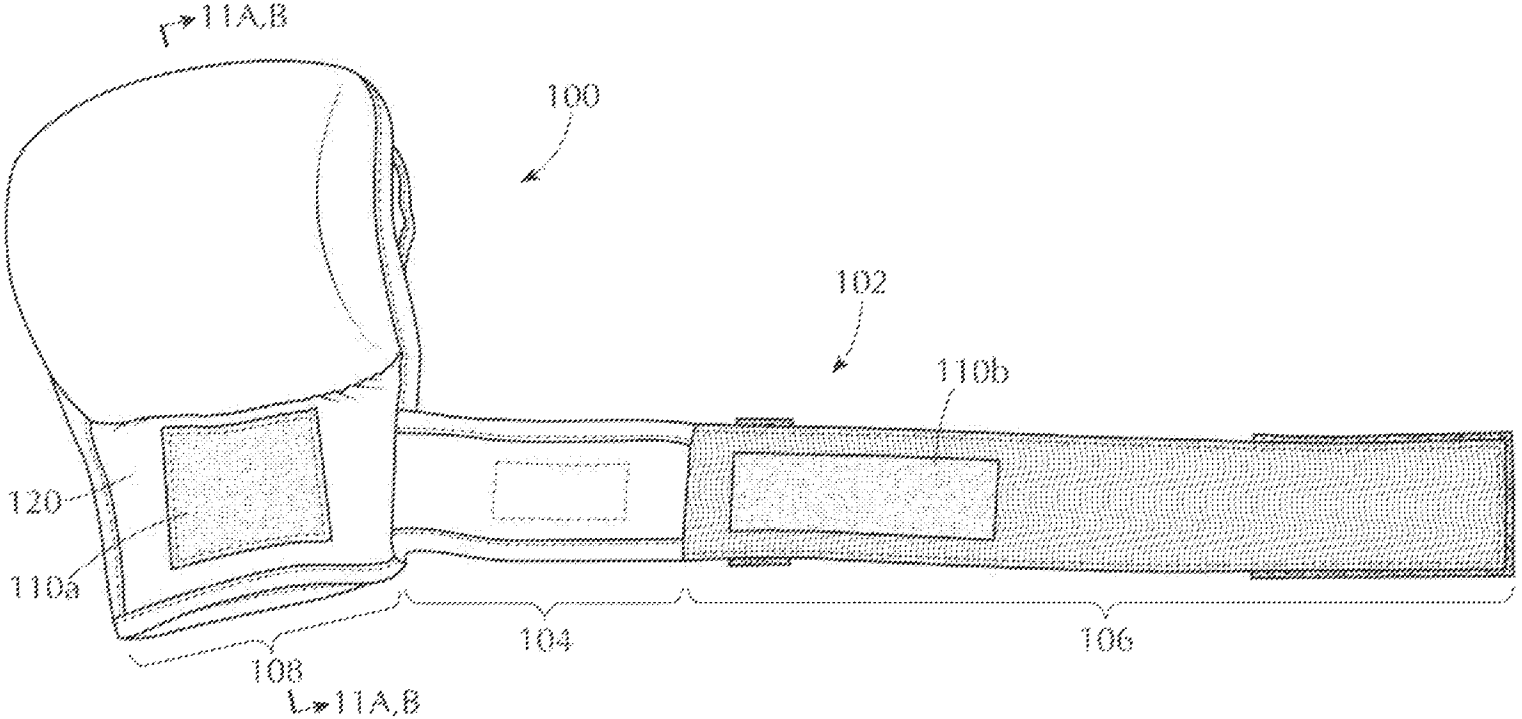
FIG. 11 is a top view of a glove with an improved strapping system.

Referring now to FIG. 11, a glove 100 is shown. The glove 100 has a unique strapping system 102 to secure the glove 100 to the fighter's hand 14. In particular, the strapping system 102 has a non-elastic portion 104 and an elastic portion 106. A wrist portion 108, the non-elastic portion 104 and the elastic portion 106 may have hooks and loops or other fastening mechanisms for securing the strap system 102. A bottom flap 118 (see FIG. 12) of the wrist portion 108 may have a first part 110 of the hook and loop system. The non-elastic portion 104 may be secured to the top flap 120 (see FIG. 11) and have a second part 112 thereon (see FIG. 11). The bottom flap 118 can be lifted up to facilitate insertion of the wrapped hand. To close the top and bottom flaps 120, 118, the second part 112 of the hooks and loops system on the underside of the non-elastic portion 104 is secured to the first part 110 of the hooks and loops system on the bottom flap 118. The elastic portion 106 is wrapped around the wrist portion 108 to further secure the glove 100 to the fighter's hand. In particular, the second part 112*a* on the elastic portion 106 is wrapped around the wrist portion 108 by stretching portion 128 and secured to the first part 110*a* on the top flap 120. The second part 112*b* is wrapped around the wrist portion 108 by stretching elastic portion 130 and secured to the first part 110*b*.

The bottom flap 118 of the wrist portion is connected to the top flap 120 on the side 122 opposite from the non-elastic portion 104 and the elastic portion 106. On the other side 124, the top and bottom flaps 120, 118 are not connected to each other except at the upper end 126. The bottom flap 118 is allowed to lift up to facilitate the insertion of the fighter's hand 14 into the glove 100 after being wrapped. However, the bottom flap 118 can only be lifted up a certain extent because the bottom flap 118 is connected to the top flap 120 at the upper end 126. However, it is also contemplated that the bottom flap 118 may be disconnected from the bottom flap 118 at 126 so that the bottom flap 118 may be fully lifted up to allow the fighter's wrapped hand 14 to be easily inserted into the glove 100. The fingers of the fighter's hand 14 are not wrapped and can be easily inserted into the finger holes of the glove 100. The bottom flap 118, after insertion of the fingers into the finger holes of the glove 100, is wrapped over the wrist and pushed down against the wrist of the fighter. In this instance, a strap 101 may be wrapped around the wrist and attached to the top flap 120 at 103. Thereafter, the non-elastic portion 104 is wrapped around the wrist so that the first and second parts 110, 112 of the hook and loop system on the non-elastic portion 104 and the bottom flap 118 are engaged to each other. This strap 101 provides the initial positioning of the top and bottom flaps 120, 118. The connection of the second part 112 of the hook and loop system on the non-elastic portion 104 and the first part of the hook and loop system on the bottom flap 118 provides the initial tension in the strapping system 102. Thereafter, the elastic portion 106 is stretched over the wrist of the fighter so that the second part 112*a* is attached to the first part 110*a* on the top flap 120. A small portion 128 of the elastic portion is stretched so that the second part 112*a* is lined up and can be secured to the first part 110*a*. The elastic portion 106 continues to be wrapped around the wrist until the second part 112*b* is aligned to and secured to the first part 110*b*. B A small portion 130 is stretched to align the second part 112*b* to the first part 110*b*. The small elastic portions 128 and 130 facilitate further tensioning within the strapping system 102 to facilitate securing the glove 100 to the fighter's hand 14.

Figure 12:
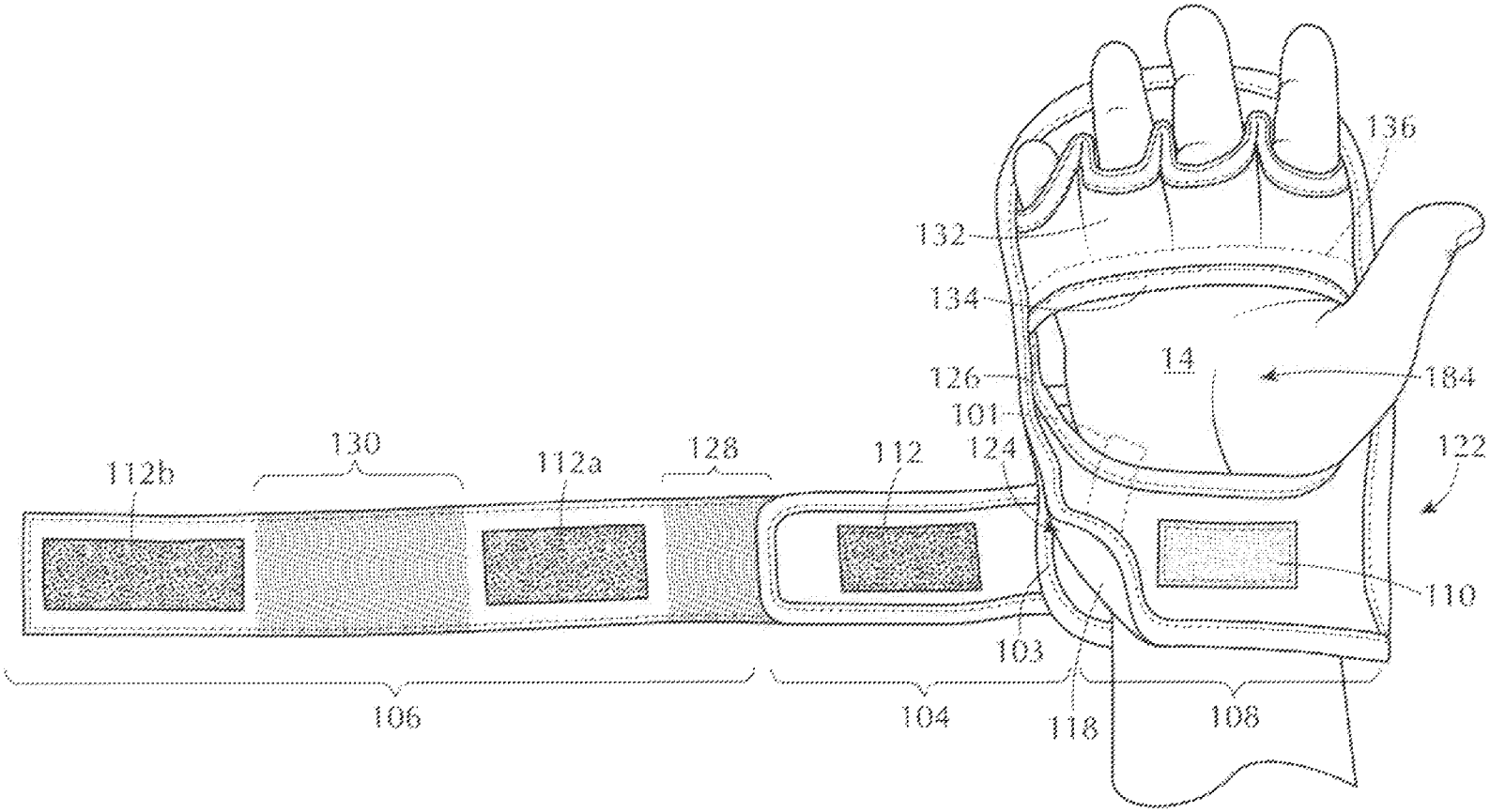
FIG. 12 is a bottom view of the glove with the improved strapping system shown in FIG. 11.

The finger holes of the glove 100 may be formed by webbing 132. The webbing 132 may form four finger holes for receiving the fighter's fingers, as shown in FIG. 12. Opposed distal end portions of the webbing 132 may be sewn to the glove padding. Also, the webbing 132 may be secured to the glove padding at three places for forming the four finger holes. A bottom end 134 of the webbing may be aligned to the finger joints 136. The bottom end 134 of the webbing 132 is shown as being disposed below the finger joints 136. However, it is also contemplated that the bottom end 134 of the webbing 132 may be aligned to the finger joints 136 for the purposes of allowing the fighter's hand to more easily grip his or her opponents arm or appendages.

In FIG. 11, the top flap 120 of the wrist portion 108 may additionally have a rectangular block of padding 138 (see FIG. 11A) or other compressible material. When the fighter's hand 14 is inserted into the glove 100, the wrist portion 108 lines up with the person's wrist. When the strapping system 102 is wrapped around the wrist portion 108 and the padding 138, the padding is compressed. The front end 140 of the padding 138 bumps up against the padding 142 covering the fighter's hand 14. In this manner, the front end 140 of the padding 138 provides support and mitigates the hand 14 from bending backward and possibly fracturing the fighter's hand 14. Moreover, the bottom surface 143 of the padding 138 pushes down on the top side of the fighter's hand to reinforce the hand 14 and mitigate hand fractures during punching.

Figure 11A:
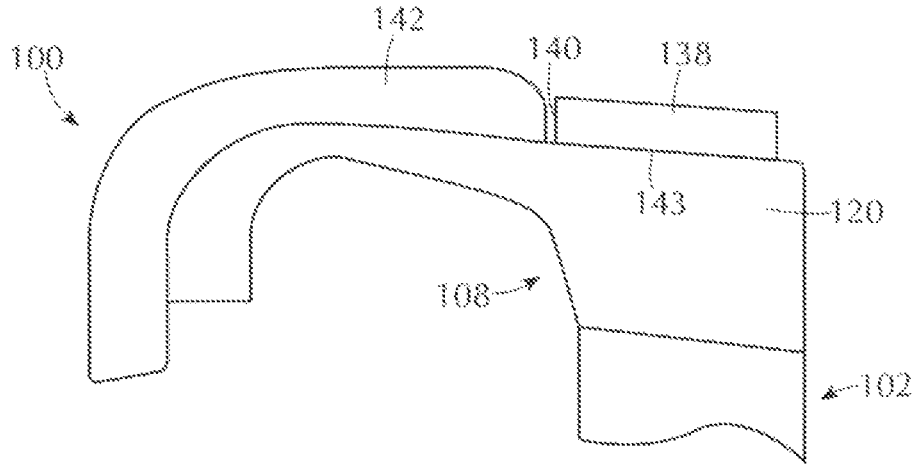
FIG. 11A is a cross-sectional view of the glove shown in FIG. 11 having a rectangular shaped support member disposed above a top of the hand.
Figure 11B:
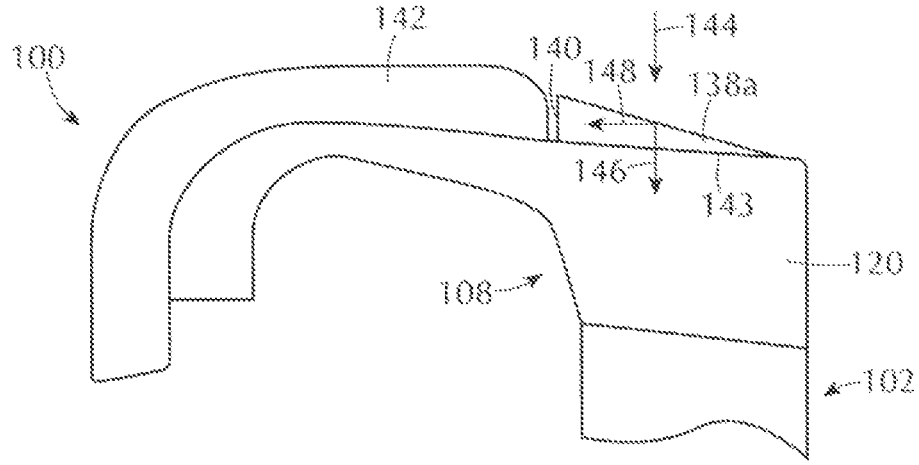
FIG. 11B is a cross-sectional view of the glove shown in FIG. 11 having a wedge shaped support member disposed above the top of the hand.

The rectangular block of padding 138 shown in FIG. 11A may be replaced with a padding 138*a* having a wedge shaped configuration shown in FIG. 11B. In this manner, when the strapping system 102 is wrapped around the wrist portion 108, the strap, namely, the non-elastic portion 104 and the elastic portion 106 pushes down on the wedge shaped padding 138*a* as shown by arrow 144. This downward pressure represented by arrow 144 has a vertical component represented by arrow 146 and a horizontal component represented by arrow 148. The vertical component 146 pushes down on the upper side of the fighter's hand to reinforce the fighter's hand to mitigate fracture during punching. The horizontal component 148 pushes the wedge shaped padding 138*a* forward. The forward pressure also places a slight forward pressure on the top of the fighter's hand to further reinforce the hand and protect the fighter's hand from fractures or injury during punching.

Figure 13:
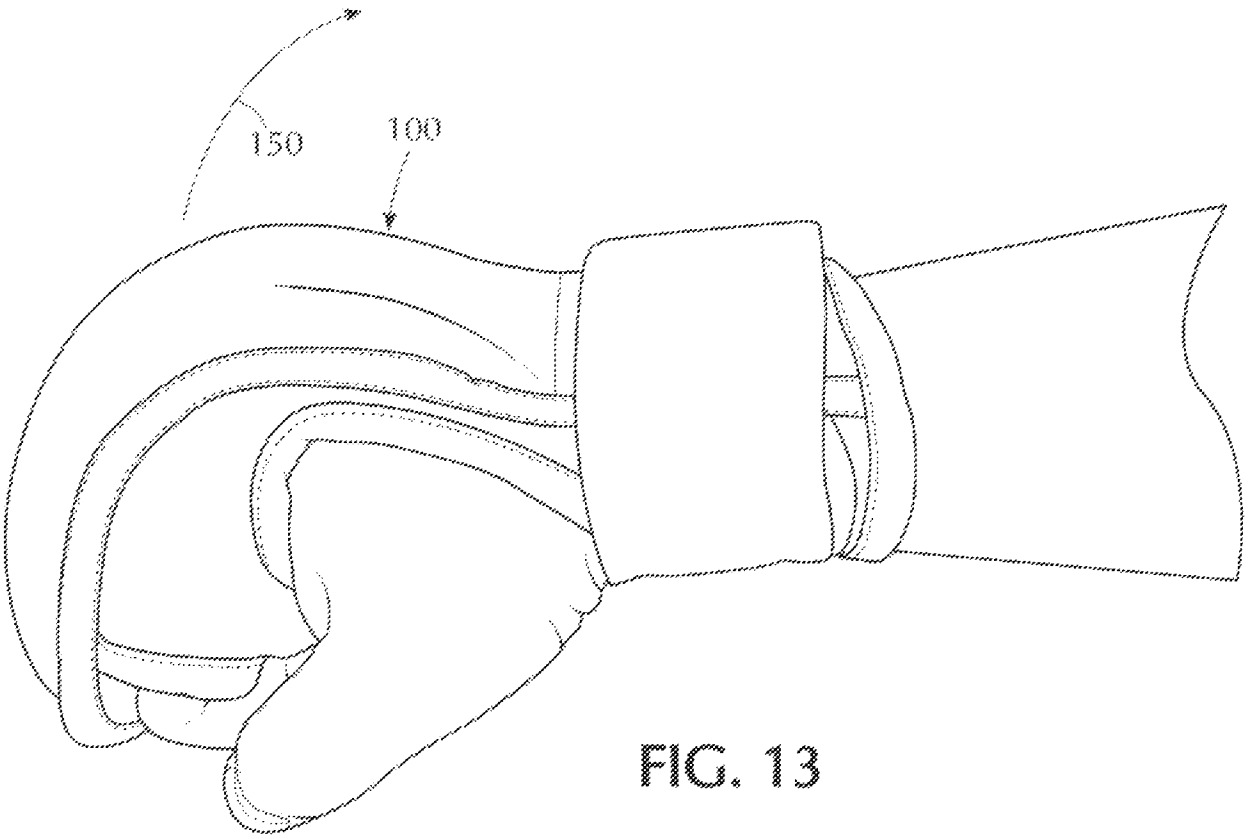
FIG. 13 is a side view of the glove shown in FIG. 11 worn by a person.
Figure 14:
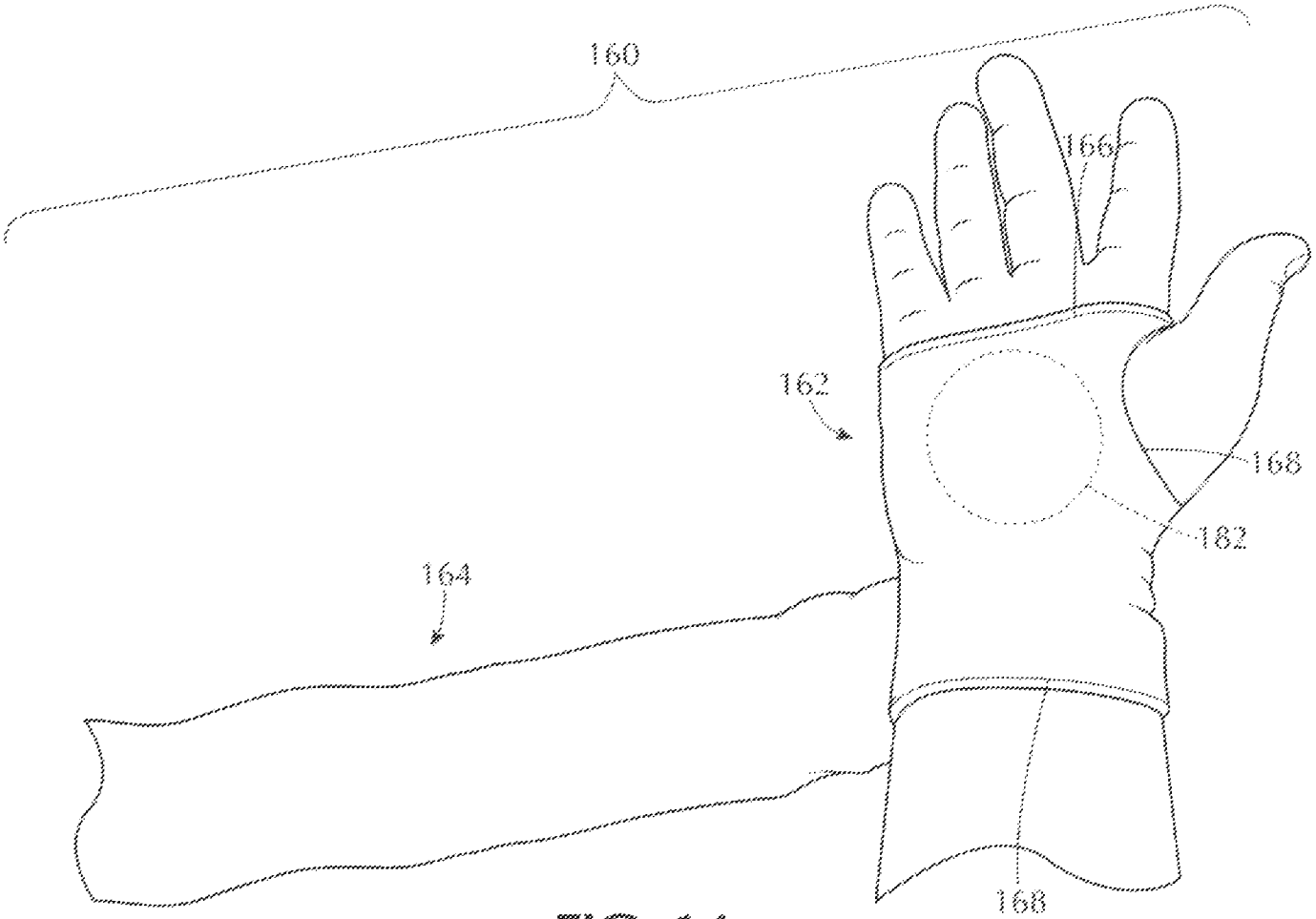
FIG. 14 is a bottom view of a hand wrap.

FIG. 13 illustrates the glove 100 without any padding 138. With the padding 138 or 138*a*, the fighter's hand is provided with additional reinforcement to mitigate excessive backward bending of the fighter's hand in the direction of arrow 150.

Referring now to FIGS. 14-18, a hand wrap 160 is shown. The hand wrap 160 includes a sleeve 162 and an elongate strip of cloth 164. The strip of cloth 162 may be attached to the exterior of the sleeve 162. The sleeve 162 may be fabricated from a generally elastic material so that the sleeve 162 compresses the fighter's hand and wrist when worn. The compression provides additional support and reinforcement to the fighter's fist to mitigate injury during fighting. By way of example and not limitation, the sleeve 162 may be fabricated from an elastic material such as spandex material, cotton, wool. Additionally, the upper end portion 166 may have an elastic band that circumscribes the hand to provide additional compression for support and reinforcement. The lower end portion 168 may also have an elastic band that circumscribes the wrist to maintain positioning of the sleeve 162 on the fighter's hand. Additionally, the sleeve 162 may have a thumb opening 168. The upper end portion 166 may be disposed about the top portion of the fighter's hand whereas the lower end portion 168 is disposed about the fighter's wrist.

Figure 15:
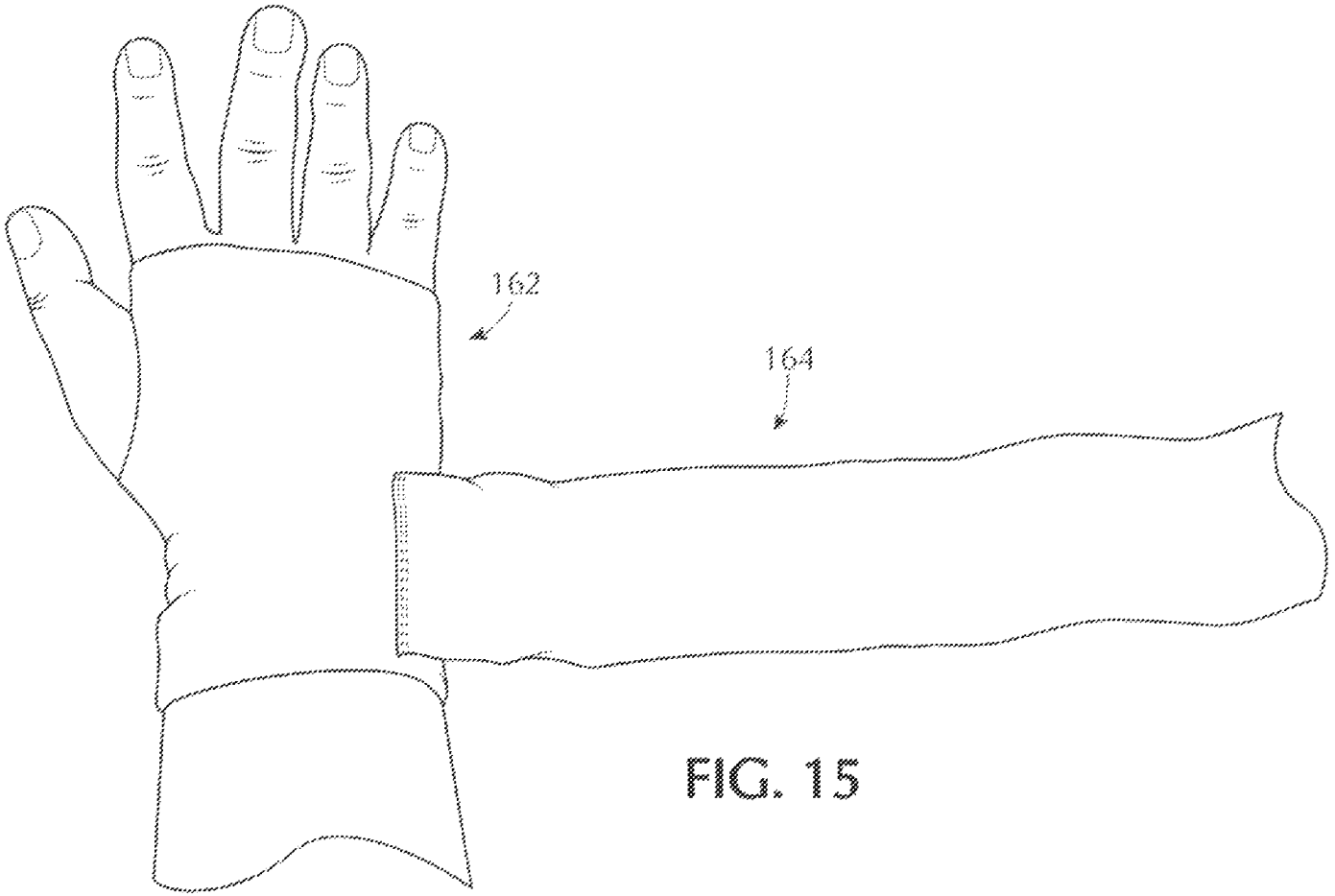
FIG. 15 is a top view of the hand wrap shown in FIG. 14.
Figure 16:
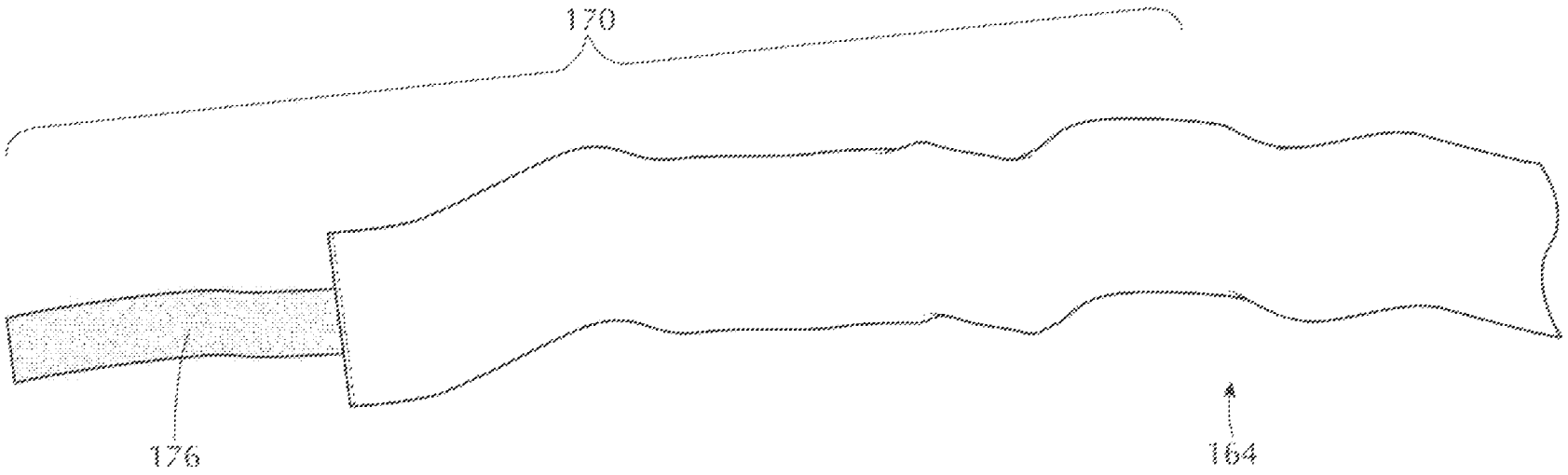
FIG. 16 is a top view of a distal end portion of a strip of cloth of the hand wrap.
Figure 17:
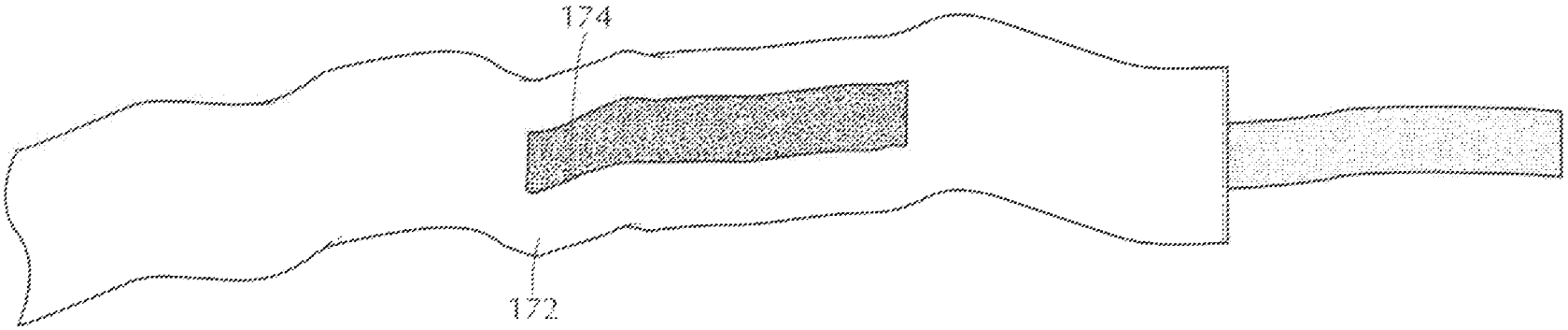
FIG. 17 is a bottom view of the distal end portion of the strip of cloth shown in FIG. 16.

As shown in FIG. 15, the strip of cloth 164 is secured to the sleeve 162 by way of stitching or other fastening mechanism. After the fighter puts on the sleeve 162, the strip of cloth 164 may be wrapped around the fighter's wrist, hand and between the fingers. Since many fighter's wrap their own hands, this wrap 160 provides a convenient to use wrapping system. The distal end portion 170 of the strip of cloth 164 may have a hook and loop fastening system. In particular, as shown in FIG. 17, a first side 172 may have a first part 174 of the hook and loop system. The distal end of the strip of cloth 164 may have a strip of a second part 176 which faces a second side 170 which engages the first part 172 of the hook and loop fastening system to complete and secure the strip of cloth 164, as shown in FIG. 18.

Figure 18:
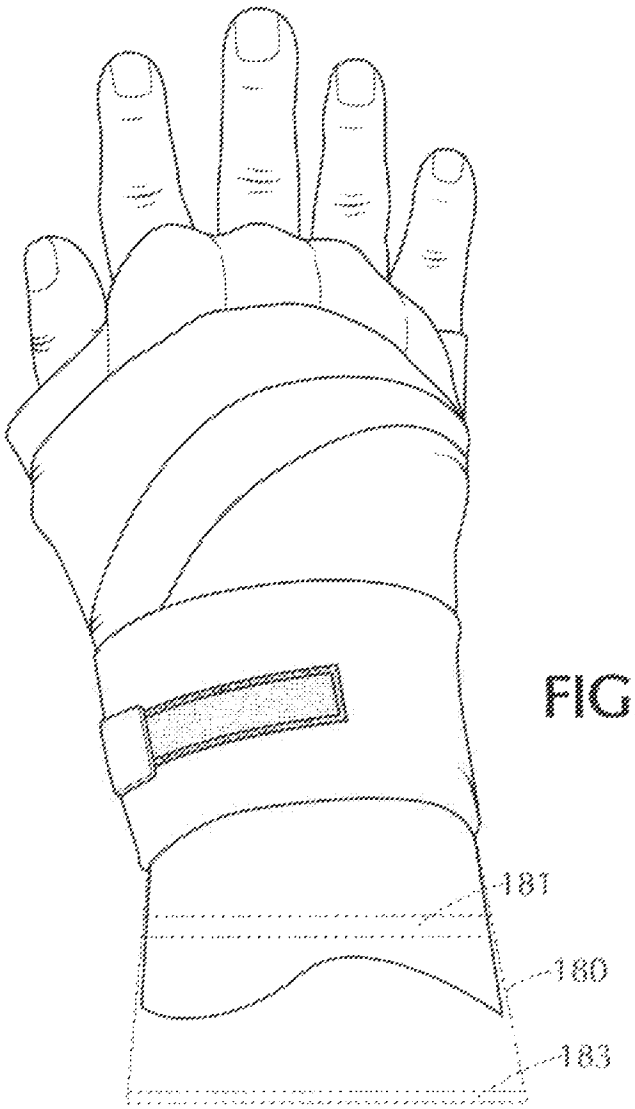
FIG. 18 is a top view of the hand wrap wrapped around a fighter's hand.

The compression sleeve 162 may be lengthened as shown in dash lines in FIG. 18. This lengthened portion is identified as 180. After inserting the wrapped hand into a glove and securing the glove with its strap system, the portion 180 of the sleeve 162 that extends below the strap system of the glove may be folded back over the strap system to cover any rough edges to mitigate cutting a trainee or another fighter. Two elastic bands 181, 183 may be attached to the extended portion 180 of the sleeve. The elastic band 181 is positioned so that when the sleeve portion 180 is wrapped back over the strap system, the elastic band 181 rides on the strap system. The elastic band 183 is positioned and the sleeve portion 183 is sufficiently long so that the elastic band 183 extends above the strap system when the sleeve portion 183 is wrapped back to prevent the sleeve portion 180 from dislodging and exposing the strap system. It is also contemplated that the sleeve 162 and the sleeve portion 183 may be a unitary elastic sleeve.

The sleeve 162 is shown and described as covering the palm of the fighter's hand. However, it is also contemplated that the sleeve 162 may be formed with a hole 182 that generally matches the hole 184 (see FIG. 14) on the palm side of the glove. The sleeve 162 is also described with the strip of cloth 164 attached to the sleeve 162. However, it is also contemplated that the sleeve 162 may be utilized without the strip of cloth 164.

Figure 19:
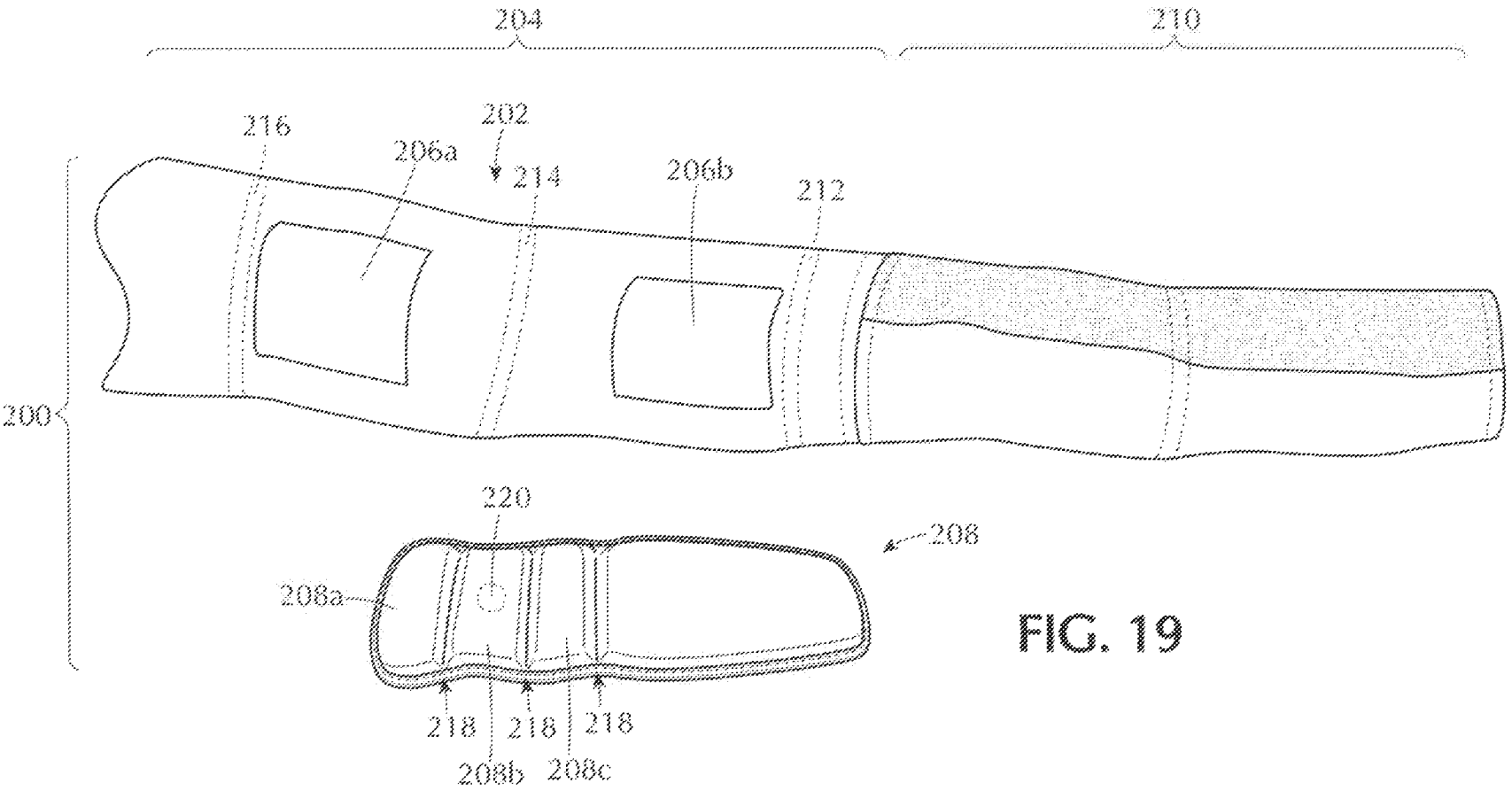
FIG. 19 illustrates a forearm and elbow pad securable to a fighter's forearm and elbow with a garment worn by the fighter.
Figure 20:
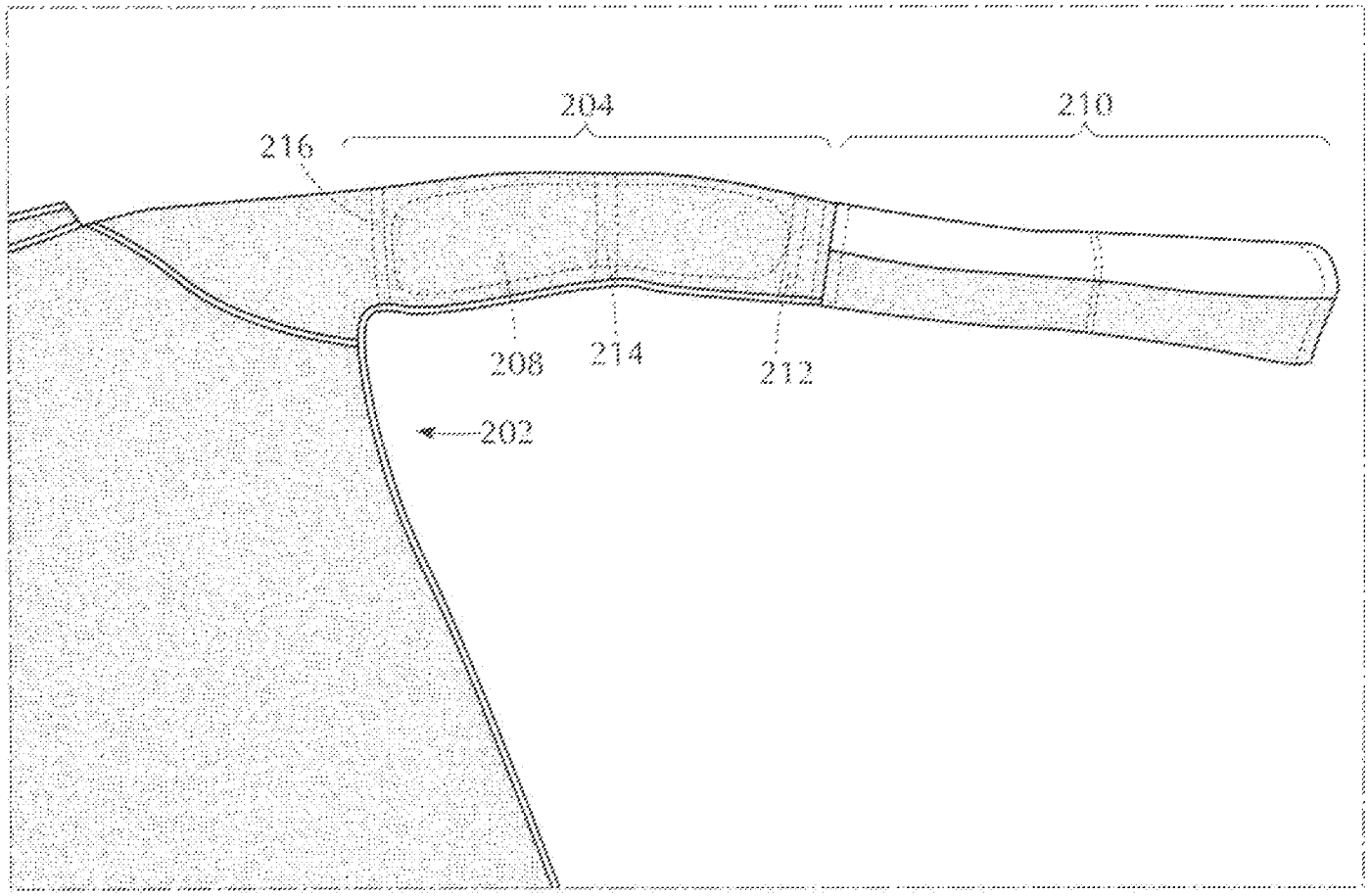
FIG. 20 illustrates the forearm and elbow pads secured to a sleeve of the garment and having an outer compression sleeve for further securing the forearm and elbow pad in place during training.
Figure 21:
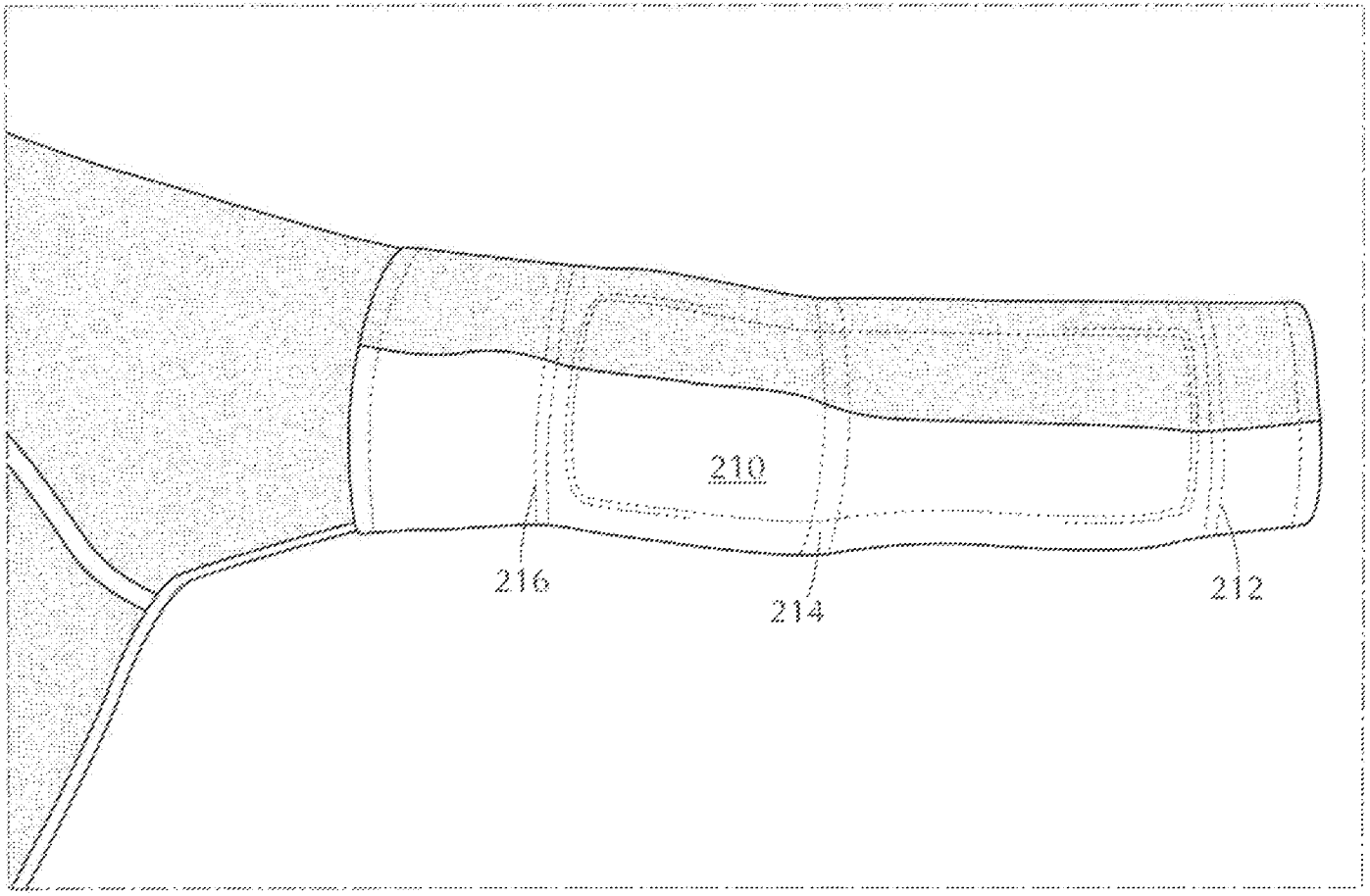
FIG. 21 illustrates the outer compression sleeve disposed over the pad.

Referring now to FIGS. 19-21, an elbow and forearm pad system 200 is shown. The system 200 comprises a shirt 202 with arm sleeve 204 and a compression sleeve 210 attached to and its distal end. The shirt 202 with arm sleeve 204 should be sized to fit tight on the person wearing the shirt 202. On the inside of the arm sleeve 204, first and second pockets 206*a, b* are formed to receive a forearm and elbow pad 208. The forearm and elbow pad 208 may be inserted into the first and second pockets 206*a, b* to retain the pad 208 in position on the arm sleeve 204 during training. Moreover, as shown in FIG. 20, the arm sleeve 204 has an extra compression sleeve 210. After placing the pad 208 in the first and second pockets 206*a, b*, the person wears the shirt 202. After positioning the forearm and elbow pad 208, the compression sleeve 210 is folded back and placed over the arm sleeve 204, as shown in FIG. 21. The compression sleeve 210 may have three compression bands 212, 214, 216. The first compression band 212 may be disposed just below the forearm and elbow pad. The second compression band 214 may be aligned to one of the grooves 218 formed in the forearm and elbow pad 208. The third compression band 216 may be positioned above the forearm and elbow pad 28. These compression bands 212, 214 and 216 secure the forearm and elbow pad 208 on the fighters forearm and elbow in position during training and grappling. Additionally or alternatively, it is also contemplated that one or more of the three compression bands 212, 214 and 216 may also be secured to the arm sleeve 204. The first compression band 212 may be disposed just below the forearm and elbow pad. The second compression band 214 may be aligned to one of the grooves 218 formed in the forearm and elbow pad 208. The third compression band 216 may be positioned above the forearm and elbow pad 28. These compression bands 212, 214 and 216 formed on the arm sleeve 204 and compression sleeve 210 secure the forearm and elbow pad 208 on the fighters forearm and elbow in position during training and grappling.

Referring back to FIG. 19, the forearm and elbow pad 28 is positioned on the forearm and elbow of the fighter's arm. In particular, the elbow of the fighter may be positioned at location 220. When the fighter bends his or her elbow, pad 208*a* and pad 208*c* are pivoted around the fighter's elbow. Pad 208*b* flexes around the elbow. As the pad 208*b* is flexed and bent, the opposed edges 222*a, b* do not wrinkle because the opposed edges have concaved curvatures.

Figure 22:
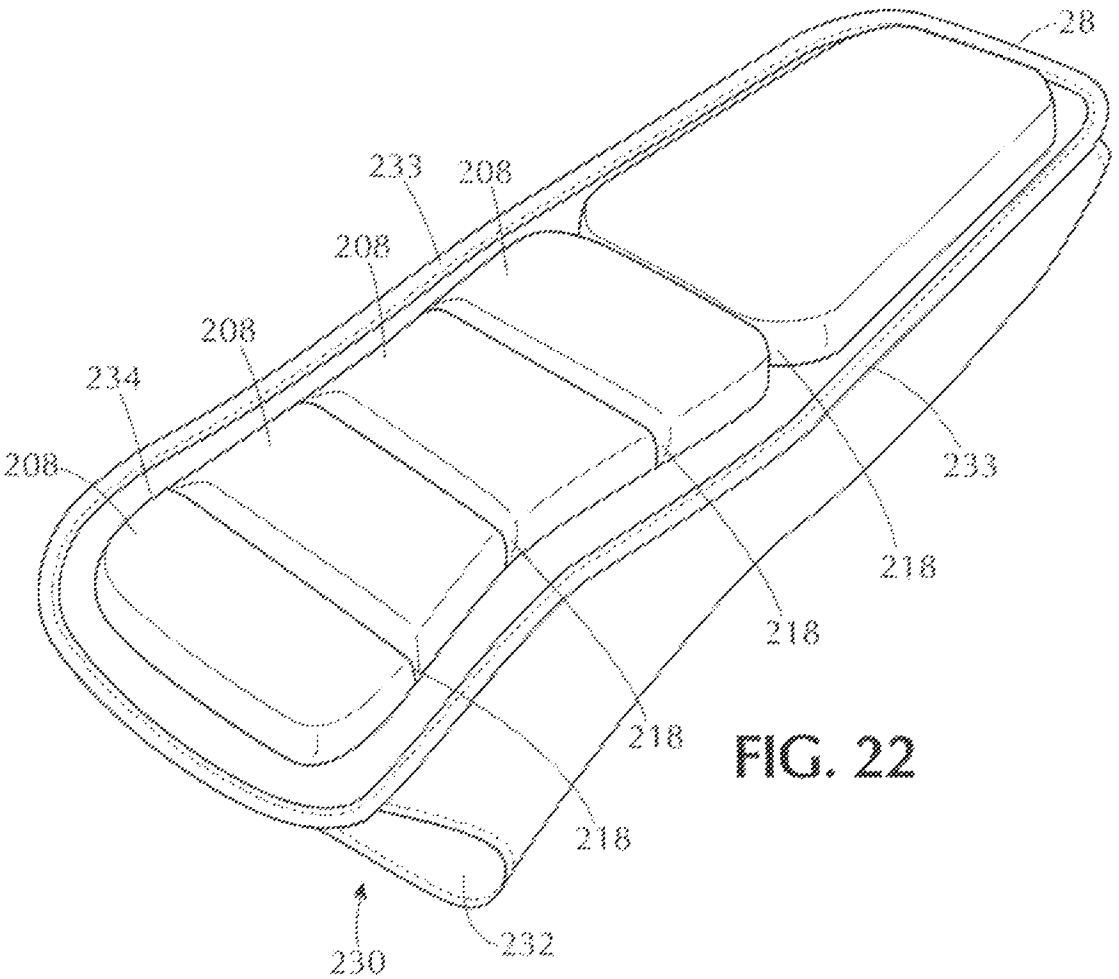
FIG. 22 illustrates an alternate embodiment of the forearm and elbow pad incorporated into a separate sleeve.

Referring now to FIG. 22, an alternative embodiment for the forearm and elbow pad 28 is shown. The forearm and elbow pad 28 may be incorporated into a separate sleeve 230 which can be worn with any type of shirt 202 or even shirtless. The separate sleeve 230 incorporating the forearm and elbow pad 28 has an elastomeric bottom sleeve 232 attached to an upper flat panel 234. The upper flat panel 234 may have the forearm and elbow pad 28 incorporated therein. The forearm and elbow pad 28 may have a plurality of pads 208 separated by grooves 218. The pads 208 may butt up against each other so that there is no gap between the pads 208 and the fighter's elbow does not directly contact his or her opponent or training partner. The flat panel 234 is shown as extending wider and longer than the plurality of pads 208. However, it is also contemplated that the outer periphery of the flat-panel 234 may be coextensive with the outer periphery of the plurality of pads 208. The flat-panel 234 is preferably fabricated from a non-elastic material. However, it is also contemplated that the flat-panel 234 may be fabricated from other types of materials including elastomeric materials.

The bottom sleeve 232 may be fabricated from an elastic material and may extend a substantial portion of the length of the flat-panel 234. The bottom sleeve 232 may be secured to opposed longitudinal edges 233 of the flat-panel 234 or the opposed side edges of the plurality of pads 208. The bottom sleeve 232 may be secured to the flat-panel 234 by way of stitching or other means known in the art such as adhesive, etc.

In use, the fighter may slip the separate sleeve 230 over his or her arm and align the plurality of pads on his or her forearm and elbow to protect their opponent.

As used herein, the first part 110 and the second part 112 of the hooks and loops system may respectively be hooks or loops, or vice versa.

The various embodiments disclosed herein were discussed in relation to MMA sports. However, the various embodiments may be used in other fighting sports including but not limited to Muay Thai, boxing, kick boxing and any other types of fighting sports.

The above description is given by way of example, and not limitation. Given the above disclosure, one skilled in the art could devise variations that are within the scope and spirit of the invention disclosed herein, including various ways of securing the sleeve 18 to the glove 100. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A fighting glove, the glove comprising:

a finger section having four finger tubes configured to terminate at a midpoint of a fighter's fingers, the finger section defining an exterior area and an interior area, the exterior area having a first padding to soften a punch to an opponent, the interior area being sufficiently thin so that the fighter can grab an appendage of the opponent when desired;

a second padding integral with the finger section, the second padding defining a lateral side end area, a top area, a medial area and a bottom area, the top and lateral side end areas having separate pads, the lateral side end area configured to be used when performing a hammer strike, the top area and the lateral side end area defining exterior surfaces which are blended to each other to mitigate cutting of the opponent during a fight;

a securing system attached to the second padding to secure the fighting glove to the fighter's hand; and a top layer and a lateral layer being fabricated from a unitary material, the top and lateral layers compress the top area of the second padding and the lateral side end area of the second padding to mitigate cuts on the opponent whether the fighter's hand is clenched or relaxed.

2. The glove of claim 1 wherein a single stitch runs along a length of the glove between the top and lateral side end areas.

3. The glove of claim 1 wherein the top and medial areas define exterior surfaces which are blended when the fighter's hand is clenched to mitigate cutting of the opponent during the fight.

4. A fighting glove, the glove comprising:

a finger section having four finger tubes configured to terminate at a midpoint of a fighter's fingers, the finger section defining an exterior area and an interior area, the exterior area having a first padding to soften a punch to an opponent, the interior area being sufficiently thin so that the fighter can grab an appendage of the opponent when desired;

a second padding integral with the finger section, the second padding defining a lateral side end area, a top area, a medial area and a bottom area, the top and lateral side end areas having separate pads, the lateral side end area configured to be used when performing a hammer strike, the top and lateral side end areas defining exterior surfaces which are blended to each other when the fighter's hand is clenched to mitigate cutting of the opponent during a fight;

a securing system attached to the second padding to secure the fighting glove to the fighter's hand; and wherein the lateral side end area of the second padding is configured to extend parallel to a lateral side of the fighter's hand when the glove is worn.

5. A fighting glove, the glove comprising:

a finger section having four finger tubes configured to terminate at a midpoint of a fighter's fingers, the finger section defining an exterior area and an interior area, the exterior area having a first padding to soften a punch to an opponent, the interior area being sufficiently thin so that the fighter can grab an appendage of the opponent when desired;

a second padding integral with the finger section, the second padding defining a lateral side end area, a top area, a medial area and a bottom area, the top and lateral side end areas having separate pads, the lateral side end area configured to be used when performing a hammer strike, the top and lateral side end areas defining exterior surfaces which are blended to each other when the fighter's hand is clenched to mitigate cutting of the opponent during a fight, a securing system attached to the second padding to secure the fighting glove to the fighter's hand; and a medial pad separate from the top area of the second padding, the top and medial areas defining exterior surfaces which are blended to each other when the fighter's hand is clenched to mitigate cutting of the opponent during the fight.

6. A fighting glove, the glove comprising:

a finger section having four finger tubes configured to terminate at a midpoint of a fighter's fingers, the finger section defining an exterior area and an interior area, the exterior area having a first padding to soften a punch to an opponent, the interior area being sufficiently thin so that the fighter can grab an appendage of the opponent when desired;

a second padding integral with the finger section, the second padding defining a lateral side end area, a top area, a medial area and a bottom area, the top and lateral side end areas having separate pads, the lateral side end area configured to be used when performing a hammer strike, the top and lateral side end areas defining exterior surfaces which are blended to each other when the fighter's hand is clenched to mitigate cutting of the opponent during a fight;

a securing system attached to the second padding to secure the fighting glove to the fighter's hand; and wherein the securing system has a strap for securing the glove to the fighter's hand, and the securing system further comprises a writable surface for writing indicia to identify an owner of the glove, the writable surface being coverable by the strap.

7. A fighting glove, the glove comprising:

a finger section having four finger tubes, an exterior area having a first padding to soften a punch to an opponent;

a second padding attached to the finger section to soften the punch to the opponent;

a securing system attached to the second padding to secure the fighting glove to a fighter;

an elastic sleeve permanently attached to the securing system and fabricated from a soft material having a length greater than a length of the securing system, the sleeve configured to be pulled over the securing system to cover the securing system and protect the opponent from abrasion cuts from the securing system.

8. The glove of claim 7 wherein the elastic sleeve defines first and second opposed surfaces, the elastic sleeve is attached to a lower periphery of the securing system and is configured to be pulled down and unfolded to uncover the securing system and expose the first surface of the elastic sleeve when putting on or taking off the glove from the fighter, and configured to be pulled up over the securing system and folded to expose the second surface of the elastic sleeve after putting the glove on the fighter, a free distal peripheral portion of the sleeve having an elastic band to hold the sleeve in place during a fight.

9. The glove of claim 8 further comprising friction material disposed on an inner surface of the free distal peripheral portion of the sleeve.

10. The glove of claim 7 wherein the elastic sleeve is attached adjacent to an upper area of the securing system and is configured to be pulled up to uncover the securing system when putting on or taking off the glove from the fighter, and configured to be pulled down over the securing system after putting the glove on the fighter, a free distal peripheral portion of the sleeve having an elastic band to hold the sleeve in place during a fight.

11. The glove of claim 10 further comprising friction material disposed on an inner surface of the free distal peripheral portion of the sleeve.

12. The glove of claim 7 wherein the sleeve is fabricated from spandex or neoprene.

13. The glove of claim 7 wherein the sleeve is tapered.

14. A mixed martial art hand protection system having a wrist securement device, the system comprising:

a glove having a wrist portion;

a strap having a proximal end and a distal free end, the proximal end directly secured to the glove's wrist portion, the strap having a non-elastic portion and an elastic portion, the non-elastic portion including the proximal end and the elastic portion including the free distal end;

wherein the non-elastic portion is removably securable to the wrist portion with a hooks and loops system and the elastic portion is removably securable to the non-elastic portion and the wrist portion with the hooks and loops system;

wherein the non-elastic portion is secured to a bottom flap of the wrist portion and the elastic portion is securable to a top flap of the wrist portion and to a different portion of the elastic portion.

15. A mixed martial art hand protection system having a wrist securement device, the system comprising:

a glove having first and second wrist portions;

a strap having a non-elastic portion secured to the first wrist portion and an elastic portion secured to the non-elastic portion;

wherein the non-elastic portion is sufficiently long to be removably securable to the second wrist portion with a hooks and loops system and the elastic portion is removably securable to the non-elastic portion with the hooks and loops system;

wherein a top flap has a compressible support member for reinforcing a top portion of a fighter's hand as the strap is wrapped around the first and second wrist portions of the glove.

16. The system of claim 15 wherein the compressible support member has a rectangular cross sectional configuration or a rearward facing wedge shaped cross section.

* * * * *